US009146086B2

(12) United States Patent
Peterson et al.

(10) Patent No.: US 9,146,086 B2
(45) Date of Patent: Sep. 29, 2015

(54) MUZZLELOADER BULLET SYSTEM

(71) Applicant: Alliant Techsystems Inc., Minneapolis, MN (US)

(72) Inventors: Bryan P. Peterson, Isanti, MN (US); Drew L. Goodlin, Isanti, MN (US); Erik K. Carlson, Oak Grove, MN (US); Lawrence P. Head, Cambridge, MN (US); John W. Swenson, Ham Lake, MN (US); Sharon Jones, Dayton, MN (US)

(73) Assignee: Vista Outdoor Operations LLC, Clearfield, UT (US)

( * ) Notice: Subject to any disclaimer, the term of this patent is extended or adjusted under 35 U.S.C. 154(b) by 0 days.

(21) Appl. No.: 14/041,648

(22) Filed: Sep. 30, 2013

(65) Prior Publication Data

US 2014/0130699 A1 May 15, 2014

Related U.S. Application Data

(60) Provisional application No. 61/707,520, filed on Sep. 28, 2012, provisional application No. 61/852,480, filed on Mar. 15, 2013, provisional application No. 61/802,264, filed on Mar. 15, 2013.

(51) Int. Cl.

| | |
|---|---|
| ***F42B 14/00*** | (2006.01) |
| ***F42B 30/02*** | (2006.01) |
| ***F41A 3/00*** | (2006.01) |
| ***F41C 9/08*** | (2006.01) |
| ***F42B 12/76*** | (2006.01) |
| ***F42B 5/38*** | (2006.01) |
| ***F42B 8/04*** | (2006.01) |
| ***F41A 3/58*** | (2006.01) |
| ***F41A 9/37*** | (2006.01) |
| ***F41C 7/00*** | (2006.01) |

(52) U.S. Cl.

CPC . *F42B 30/02* (2013.01); *F41A 3/00* (2013.01); *F41A 3/58* (2013.01); *F41A 9/375* (2013.01); *F41C 7/00* (2013.01); *F41C 9/08* (2013.01); *F41C 9/085* (2013.01); *F42B 5/38* (2013.01); *F42B 8/04* (2013.01); *F42B 12/76* (2013.01); *F42B 14/00* (2013.01)

(58) Field of Classification Search

CPC ..... F42B 14/064; F41C 9/08
USPC ..... 102/517–529; 89/1.3; 42/51
See application file for complete search history.

(56) References Cited

U.S. PATENT DOCUMENTS

| | | | | |
|---|---|---|---|---|
| 40,153 | A | 10/1863 | Billings | |
| 2,389,846 | A * | 11/1945 | Ericson | 102/523 |

(Continued)

*Primary Examiner* — Samir Abdosh
(74) *Attorney, Agent, or Firm* — Christensen Fonder, P.A.

(57) ABSTRACT

A bullet system including a bullet body with a tail portion engaged with a polymer cup that provides enhanced engagement of the barrel upon firing. The bullet system may have a radial retracted state that corresponds to an elongated axial state of the bullet system that allows the cupped bullet to be fed down the barrel at a reduced diameter with reduced engagement with the barrel. The radial expansion of the bullet system occurs upon axial length reduction of the bullet system by axial compression. The axial compression can occur upon firing of the propellant or when loading with the ramrod. The bullet system can provide a tactile seat force indicator tip insert within the tip of the bullet body that provides a tactile sensation when the bullet is properly seated against the propellant charge. A cutting edge may be provided for scraping the barrel upon insertion of the bullet.

17 Claims, 11 Drawing Sheets

(56) References Cited

U.S. PATENT DOCUMENTS

| | | | | | |
|---|---|---|---|---|---|
| 2,683,416 | A | * | 7/1954 | Keller et al. | 102/513 |
| 3,583,087 | A | | 6/1971 | Huebner | |
| 3,762,332 | A | * | 10/1973 | Witherspoon et al. | 102/523 |
| 4,232,468 | A | | 11/1980 | Chapin | |
| 4,239,006 | A | * | 12/1980 | Kelson | 102/522 |
| 4,437,249 | A | | 3/1984 | Brown et al. | |
| 4,815,682 | A | * | 3/1989 | Feldmann et al. | 244/3.23 |
| 5,127,179 | A | | 7/1992 | Marsh | |
| 5,388,522 | A | | 2/1995 | Martwick et al. | |
| 5,651,203 | A | | 7/1997 | Knight | |
| 5,777,256 | A | | 7/1998 | Simon et al. | |
| 5,822,904 | A | | 10/1998 | Beal | |
| 6,085,454 | A | | 7/2000 | Caudle | |
| 6,145,235 | A | | 11/2000 | Emerson et al. | |
| 6,385,887 | B1 | | 5/2002 | Johnston | |
| 6,895,865 | B2 | | 5/2005 | Bond | |
| 7,219,607 | B2 | | 5/2007 | Oertwig | |
| 7,380,505 | B1 | | 6/2008 | Shiery | |
| 7,451,705 | B2 | | 11/2008 | Fry | |
| 7,726,245 | B2 | | 6/2010 | Quesenberry et al. | |
| 8,132,348 | B1 | | 3/2012 | Post | |
| 2002/0129531 | A1 | | 9/2002 | Camp | |
| 2004/0050285 | A1 | * | 3/2004 | Zozulya et al. | 102/517 |
| 2005/0016050 | A1 | | 1/2005 | Howell, Jr. | |
| 2005/0183318 | A1 | | 8/2005 | McGivern | |
| 2006/0027128 | A1 | | 2/2006 | Hober | |
| 2006/0027130 | A1 | * | 2/2006 | Parker | 102/517 |
| 2006/0027131 | A1 | * | 2/2006 | Byer | 102/521 |
| 2006/0086029 | A1 | | 4/2006 | Kirkpatrick | |
| 2008/0282596 | A1 | | 11/2008 | DeLeeuw | |
| 2011/0296729 | A1 | | 12/2011 | Overstreet | |
| 2012/0260814 | A1 | | 10/2012 | Worrell et al. | |
| 2014/0090284 | A1 | * | 4/2014 | Peterson et al. | 42/51 |

* cited by examiner

MUZZLELOADER BULLET SYSTEM

PRIORITY CLAIM

This application claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference.

FIELD OF THE INVENTION

The present invention is directed to a bullet system suitable for muzzleloaders that improves the sealing of the bullet against the barrel during loading, and improves loading and shot accuracy. Specifically, the present invention is directed to a bullet having a radially deformable polymer component that may expand during seating or firing of the bullet to engage the barrel and to seal the bullet against the barrel and provide engravable material engagable by the rifling of the barrel.

BACKGROUND OF THE INVENTION

Muzzleloaders are a class of firearms in which the propellant charge and bullet are separately loaded into the barrel immediately prior to firing. Unlike modern breech loaded firearms where the bullet, propellant charge and primer are loaded as prepackaged cartridges, conventional muzzleloaders are loaded by feeding a propellant charge through the muzzle of the barrel before ramming a bullet down the barrel with a ramrod until the bullet is seated against the propellant charge at the breech end of the barrel. A primer is then fitted to the exterior end of a hole in the breech end of the barrel. The primer is then struck by an internal inline firing pin or an external hammer to ignite the propellant charge through the hole in the breech end of the barrel to create propellant gases for propelling the bullet.

The loading process of muzzleloaders creates issues unique to muzzleloaders. Specifically, the muzzleloader loading process requires that, unlike conventional breech loaded firearms, the bullet travel through the barrel twice, once during loading and once during firing. The tight fit of the bullet to the barrel can create substantial friction as the bullet travels through the barrel and is etched by the barrel rifling. During firing, the expanding propellant gases can overcome the frictional forces to propel the bullet through the barrel. However, during loading, the user must overcome the frictional force by applying an axial force to the bullet with the ramrod until the bullet is seated against the propellant charge. The friction between the bullet and the barrel can complicate the determination as to whether the bullet has been pushed far enough down the barrel during loading and is properly seated against the propellant charge. The relative position of the bullet to the propellant charge changes the pressurization of the barrel behind the bullet from the ignited propellant gases impacting the ballistic performance and potentially creating a substantial safety risk.

A recent trend in muzzleloading is placing an undersized bullet within a polymer sabot in a barrel sized for a larger caliber bullet. The undersized bullet body has a higher muzzle velocity than the larger caliber bullet providing improved ballistic characteristics. The sabot is sized to approximate the inner diameter of the barrel such that the sabot tightly seals against the barrel to efficiently propel the bullet and engage the rifling of the barrel to impart spin to the bullet. The sabot typically comprises a plurality of pedals or other unfurling element that unfurl from the bullet to separate the sabot from the bullet as the bullet leaves the muzzle to disengage from the bullet. While the sabot substantially improves the ballistic performance of the muzzleloader, the polymer sabot can be damaged or deformed by passing through the barrel and engaging the rifling twice. The deformation of the sabot or damage to the sabot can cause the sabot to release the bullet prematurely or impart a wobble to the bullet.

A similar concern with muzzleloaders is that the slower burning propellant required by muzzleloaders often foul the barrel with unconsumed residue requiring frequent cleaning of the barrel. The fouling often occurs so quickly that the barrel must be cleaned after every shot. The fouling can also interfere with the operation the sabot causing the sabot to begin to unfurl from the bullet prematurely within the barrel or break up within the barrel. In addition to contributing the fouling of the barrel, the deformation or damage to the sabot can impart wobble into the bullet or otherwise impact the ballistic performance of the bullet.

An additional complication is that the actual inner diameter of the barrel for given caliber can vary from manufacturer to manufacturer. A 50 caliber barrel can have an actual inner diameter ranging from 0.497 to 0.505 inches depending on the manufacturer. Similarly, a 45 caliber bullet saboted for use in a 50 caliber barrel can have an outer diameter varying from 0.450 to 0.452 inches, which in turn changes the outer diameter of the sabot the bullet is seated within. Although the variance is relatively small, the variance in tolerances between the inner diameter of the barrel and the outer diameter of the sabot can result in substantially increased friction between the cupped bullet and the barrel, which can cause the bullet to become stuck within the barrel during firing or loading. Similarly, an improper fit between the barrel and an undersized sabot can create an inefficient seal between the sabot and the barrel allowing gases to escape around the bullet during firing. Accordingly, if the sabot-bullet pairing is not properly selected, the effectiveness of the muzzleloader can be substantially impacted.

A similar variability in muzzleloaders not present in cartridge based firearms is the variability of the size of the propellant charge. Unlike cartridge firearms where a cartridge is preloaded with a bullet and premeasured quantity of propellant is loaded into the firearm for firing, the bullet and propellant charge are combined within the firearm for firing. Accordingly, the muzzleloader operator can select the optimal bullet, propellant type and quantity combination for each shot, which is particularly advantageous given the long reloading time for muzzleloaders. While the variability of the bullet—propellant charge combination allows for an optimized shot, varying the bullet and in particular the propellant and quantity of propellant can significantly change the appropriate seating depth of the bullet. With loose or powdered propellant such as black powder, the amount of propellant is often varied between 80 and 120 volumetric grains. Similarly, propellants are often formed into cylindrical pellets that are stacked end-to-end within the barrel to form the propellant charges. The pellets are typically each about 1 cm in length and loaded in 1 to 3 pellet groups causing an even greater variation in the seating depth.

A common approach to determining whether a bullet has been properly seated involves marking the ramrod with a visual indicator that aligns with the muzzle of the barrel when the end of the ramrod is at the appropriate depth with the barrel. The visual indicator is typically marked by loading the propellant charge and ramming a test bullet through the barrel. Once the user is certain that the bullet is properly seated against the propellant charge, the corresponding portion of the ramrod at the muzzle is marked. Although this approach is relatively easy to implement and widely used, the visual indicator approach detracts from the primary advantages of muzzleloaders. As the visual indicator approach is set based on a particular propellant charge and bullet combination, a variation in the propellant charge that changes the dimensions of the propellant charge can render the visual indicator at best useless or at worse a safety risk giving a false appearance of a properly seated bullet.

As discussed above, the fouling can interfere with the safe operation of the muzzleloader as well as the ballistic performance of the bullet. While firing the muzzleloader can be comparatively safer method of unloading the bullet, the muzzleloader must often be cleaned after each firing. In a hunting situation where the muzzleloader may be fired several times to unload the muzzleloader for transport, the barrel may require cleaning, which can be difficult in the field.

A current approach to addressing the reloading problem is replacing the closed breech end of the muzzleloader barrel with a screw-in, removable breech plug. The breech plug is removable from the breech end of the muzzle to remove the propellant charge from behind the bullet rather than attempting the remove the bullet from the muzzle end of the barrel. While the approach is effective in safely separating the propellant charge from the bullet, a common problem with removable breech plugs is seizing of the breech plug within the barrel. The rapid temperature changes during firing as well as the corrosive nature of many of the propellants can result in seizing of the corresponding threads of the breech plug and the barrel. If not carefully maintained, the breech plug will become difficult to remove to efficiently unload the muzzleloader.

A related concern is that the performance of the hygroscopic propellant itself can be easily and often detrimentally impacted by the environmental conditions in which the propellant is stored. The sensitivity of the propellant can often result in "hang fires" where the ignition of the propellant charge is delayed or the propellant charge fails to ignite altogether. Hang fires are frequent occurrences and create a substantial risk for the user. The conventional approach to dealing with a hang fire is to point the muzzleloader in a safe direction until the muzzleloader fires or until sufficient time has passed to reasonably assume that the propellant charge failed to ignite altogether. The unloading process through the muzzle of the muzzleloader is particularly dangerous in hang fire situations as the propellant charge may ignite during the actual unloading process. Similarly, unloading through a breech plug can similarly be dangerous as the propellant charge may ignite as the breech plug is removed.

Another safety concern unique to muzzleloaders is an undersized or oversized propellant charge. Unlike cartridge firearms where the amount of propellant loaded for each shot is limited by the internal volume of the cartridge, the amount of propellant loaded for each shot in muzzleloaders is only limited by the length of the barrel. While measures are often used to provide a constant quantity of propellant for each propellant charge, the measures can be difficult to use in the field or in low light situation when hunting often occurs. Similarly, propellant can be formed into the pre-sized pellets that can be loaded one at a time until the appropriate amount of propellant is loaded. As with the measure, loading the appropriate number of pellets can be challenging in the field or in low light situations.

The fit between the barrel and bullet can impact the ballistic performance of the muzzleloader. However, tightly fitting the bullet to the barrel can make properly seating of the bullet against the propellant charge and determining the position of the bullet within the barrel during loading difficult. Accordingly, there is a need for efficiently loading and seating a muzzleloader bullet within the barrel while tightly fitting the bullet to the walls and rifling of the barrel.

SUMMARY OF THE INVENTION

A bullet system suitable for muzzleloaders, according to an embodiment of the present invention, can comprise a bullet body and a radially deforming polymer component that expands during seating of the bullet or firing of the bullet to seal the bullet against the walls of the barrel. The radial expansion of the polymer component also provides engravable material that can be engaged by the barrel rifling to impart spin to the bullet as the bullet travels through the barrel.

In embodiments, bullet components are axially movable with respect to one another to effect a radial expansion, and/or provide a tactile indication of seating. The bullet system can also comprise a seat force indicator tip insert that provides a tactile sensation when the bullet is properly seated against the propellant charge.

In one embodiment, the bullet can comprise a tail portion of a bullet body positionable within a well cavity defined by a radially deforming polymer cup. When used herein "bullet" includes a bullet body and components or accessories engaged therewith to be discharged with the bullet body, for example a cup engaged therewith. A "cup" typically has a closed end and an open axial end engaged with a portion of a bullet body. A cup can be attached to the bullet body, a "cupped bullet", so that is does not separate; the cup can be separable after the bullet leaves the barrel, such as a sabot; "cup" used herein includes "sabots". A "bullet system" when used herein, includes a plurality of bullet components, for example a bullet body and the cooperating cup. It can also include associated components such as driving bands, propellant, a ramrod, and/or the firearm depending on the context.

In an embodiment, the tail portion can be moved axially within the well cavity of the cup between an axial extended position in which the tail portion partially extends from the well cavity and an axial retracted position in which the tail portion is fully seated within the well cavity. During loading, the tail portion of the bullet is positioned in the axial extended position as the bullet is fed into the muzzle and pushed down the barrel. In the axial extended configuration, the outer diameter of the cup approximates or is less than the inner diameter of the lands of the barrel rifling such that the cupped bullet can be pushed down the barrel with a ramrod with no or minimal engagement of the cup to the rifling. The minimal engagement of the cup allows the cupped bullet to be loaded with less friction between the barrel and the bullet such that user can determine tactilely when the bullet is seated against the propellant charge.

Once the cupped bullet is seated, a continued axial force applied to the cupped bullet with the ramrod causes the tail portion to move into the retracted position within the cup. The cup can be generally deformable and comprise a deformable portion adapted to expand radially outward as the tail portion is pushed into the retracted position to seal the cup against the barrel. The radially expansion of the cup allows for an effective seal against the barrel without having to overcome the friction between the barrel and the bullet created when the bullet is tightly fitted to the inner diameter of the barrel. Accordingly, the radially expanding cup can also reduce the effect of manufacturer variances in barrel diameter on ballistic performance as the radial expansion of the cup effectively adapts the outer diameter of the cup to the relative difference in diameter between the initial outer diameter of the cup and the inner diameter of the barrel. The radially expanded portion of the cup can also provide engravable material that can be engaged by the rifling of the barrel to impart spin to the bullet as the cupped bullet travels along the barrel during firing.

In one aspect, the cup defines a reduced diameter portion within the well cavity engagable by the tail portion of the bullet as the tail portion is moved axially from the axially extended position into the axially retracted position. The cup can comprise a deformable portion at the reduced diameter portion such that the engagement of the tail portion to the reduced diameter portion causes the deformable portion to expand radially outward to engage and seal against the barrel. In another aspect, the cup can comprise a quantity of incompressible material positioned within the well cavity between the tail portion and the closed end of the well cavity. As the bullet is pressed into the retracted position, the tail portion presses against the incompressible material causing the deformable portion of the cup at the incompressible material to expand radially outward. In one aspect, the cup can comprise circumferential axial scoring around the exterior of the cup at the deformable portion to control the radial expansion of the deformable portion. The scoring facilitates even radial expansion of the deformable portion of the cup.

In one aspect, the cup can further comprise a collar portion defining a second reduced diameter portion engaging the tail portion. In this configuration, the tail portion can comprise a notch positioned on the tail portion to engage the reduced diameter portion when the tail portion is positioned in the extended position. The notch maintains the bullet in the extended position as the cupped bullet is pushed down the barrel during loading. In one aspect, the reduced friction between the cupped bullet and the barrel allows the bullet to be pushed down the barrel without disengaging the second reduced diameter portion from the notch and pressing the tail portion into compressed position. Upon seating the cupped bullet against the propellant, the cupped bullet is braced against propellant such that sufficient axial force can be applied to the bullet to collapse the tail portion and radially expanding the cup.

In an embodiment, the bullet has a first axial length with a first maximum radius, and a shorter second axial length that corresponds to a second greater maximum radius. By way of engaged members with respective engaged annular surfaces and at least one of the engaged annular surfaces being a tapered surface, the bullet radially expands from the first maximum radius to the second greater maximum radius when the bullet is axially compressed from the first axial length to the shorter second axial length. The bullet has a polymer outer surface engravable by barrel rifling.

In an embodiment, the bullet has a first axial length and has an expandable barrel engagement portion with a first maximum radius, and the bullet having a shorter second axial length that corresponds to the expandable barrel engagement portion having a second greater maximum radius. By way of one surface of one member engaging a ramp (in cross section) that is, a tapered annular surface of another axially adjacent member, the bullet radially expands from the first maximum radius to the second greater maximum radius when the bullet is axially compressed from the first axial length to the shorter second axial length. In embodiments, the expandable barrel engagement portion has a polymer outer surface engravable by barrel rifling.

In an embodiment, the bullet has a first axial length and has a polymer barrel engagement portion with a first maximum radius, and a shorter second axial length that corresponds to a second greater maximum radius. By way of cooperating conical surfaces, the bullet radially expands by way of a radially expanding member from the first maximum radius to the second greater maximum radius when the bullet is axially compressed from the first axial length to the shorter second axial length.

In an embodiment, the bullet has a first axial length with a first maximum radius, and a shorter second axial length that corresponds to a second greater maximum radius. The bullet is loaded into a barrel at the first axial length with the first maximum radius and when discharged down the barrel is at a second shorter axial length and a second greater maximum radius. By way of cooperating frustoconical surfaces, the bullet radially expands from the first maximum radius to the second greater maximum radius when the bullet is axially compressed from the first axial length to the shorter second axial length. The bullet has a polymer outer surface engravable by barrel rifling.

In an embodiment, the bullet has a first axial length with a first maximum radius, and a shorter second axial length that corresponds to a second greater maximum radius. By way of means for radial expansion, the bullet radially expands from the first maximum radius to the second greater maximum radius when the bullet is axially compressed from the first axial length to the shorter second axial length.

In embodiments, the radially expanding member is a polymer and has a polymer outer surface engravable by barrel rifling that is part of the expanding member. In an embodiment the radially expanding member is a malleable and engravable metal, such as lead, that has an outer surface that is engravable. In embodiments, the radially expanding member is fixed to, that is, non-detachable, to a bullet body, forward of the radially expanding member. In embodiments, the radially expanding member is a cup and separates from a bullet body after the bullet body and cup leaves a barrel.

A muzzleloader bullet system, according to an embodiment of the present invention, can comprise a bullet body and a polymer component having a radial cutting ring. The radial cutting ring cuts through barrel fouling buildup while the bullet is loaded into the barrel, thereby improving shot accuracy and reducing the force needed to load the bullet, and reduce cleaning in between shots. The radial cutting ring can be serrated and have a cutting edge facing rearwardly.

In an embodiment, the cup can further comprise a quantity of incompressible material positioned beneath the tail portion within the well cavity, wherein moving the tail portion into the retracted position presses the incompressible material radially outward to deform the cup.

The incompressible material can be used in place or in addition to the reduced diameter portion to facilitate radial expansion of the cup. The incompressible material can be a contained fluid.

In another embodiment, the bullet can comprise a bullet body defining a boat tail and further comprise a radially deforming polymer obturation skirt fitted to the boat tail. The boat tail provides a camming surface that radially spreads the obturation skirt as the obturation skirt is forced against the rear of the bullet during firing. Conventional obturation skirts have a rear facing cup portion to capture the expanding propellant gases from the ignited propellant charges such that the walls of the cup portion deform radially outward to obturate against the barrel. The camming surface of the boat tail of the present invention relies on the axial force applied to the obturation skirt by the propellant gases to facilitate radial expansion of the obturation skirt. The camming surface permits radial expansion of the obturation skirt without relying on the difficult to predict and often uneven radial deformation of the cup portion from the expanding propellant gases.

The obturation skirt covers the boat tail prior to firing to create a conventional bullet shape to improve the obturation of the obturation skirt to the barrel and the engagement of the obturation skirt to the rifling. Upon separation of the obturation skirt from the bullet upon leaving the barrel, the more aerodynamic boat tail of the bullet is exposed to improve the overall ballistic characteristics of the bullet. The separable obturation skirt provides the obturation and rifling engagement advantages of a conventional bullet shape during firing while providing the aerodynamic and ballistic advantages of a boat tailed bullet in flight.

As with the cup, in an embodiment, the axial force for pressing the obturation skirt against the boat tail can be applied to the bullet by applying an axial force to the bullet with a ramrod to seat the obturation skirt against the propellant charge. The seating force presses the boat tail against the obturation skirt, which is braced against to the propellant charge, to radially expand the obturation skirt. In an embodiment, the obturation skirt can be sized to approximate the inner diameter of the rifling such that the bullet does not or minimally engages the rifling. In this configuration, the minimal contact between the rifling and the bullet allows the user to easily determine tactilly when the bullet is seated against the propellant charge reducing the risk that the bullet will not be properly seated against the propellant charges and the associated risks.

In an embodiment, the bullet body can further comprise an axial well cavity extending through the boat tail and centered on the central longitudinal axis of the bullet body. Correspondingly, the obturation skirt can further comprise an axial post insertable within the well cavity to center the obturation skirt relative to the bullet body. The axial post can maintain the obturation skirt centered as the obturation skirt is pushed into the camming surface to further prevent uneven radial expansion of the obturation skirt. In an embodiment, the axial post can comprise at least one radial protrusion engageable to the walls of the well cavity. In this configuration, the well cavity can further comprise at least one detent engageable by the protrusion to fix the obturation skirt in at least one position.

In an embodiment, the axial post defines a lumen for conveying a quantity of propellant gas through the axial post into the well cavity. In this configuration, the well cavity can further comprise a pressure chamber at one end of the cavity for receiving the propellant gases conveyed by the lumen. During firing, the pressure chamber is pressurized as propellant gases enter the well cavity through the lumen. The propellant gases within the well cavity are further pressurized as the axial post moves axially forward as the obturation skirt is pushed by the expanding propellant as the bullet is propelled down the barrel during firing. Upon exiting the barrel, the ignited propellant gases behind the obturation skirt are dissipated allowing the pressurized gases within the pressure chamber to push the axial post axially rearward to disengage the obturation skirt from the bullet.

As shown in U.S. Pat. No. 6,782,830, similar problems exist with large smooth bore weapons such as mortars. As with muzzleloaders, mortars travel through barrel twice, once during loading and once during firing. In an embodiment, an obturation skirt according to an embodiment of the present invention can be fitted to the boat tail of a mortar round, wherein the boat tail of the mortar round acts as a camming surface to facilitate radial expansion of the boat tail during firing.

In one embodiment, the bullet can comprise an undersized bullet body having an overmolded polymer jacket having at least one polymer driving band expanding circumferentially around the bullet body. The driving bands extend radially outward to engage the walls and rifling of the barrel to seal the bullet against the barrel and impart spin to the bullet.

In an embodiment, the driving band can deform to seal against the barrel walls during firing to efficiently fire the bullet. In embodiments, the overmolded jacket does not comprise petals or other unwinding elements that can be damaged or deformed by fouling within the barrel.

In an embodiment, the number and dimensions of the driving bands can be varied to increase or decrease the contact area between the polymer jacket and the barrel, which increases or decreases the friction between the polymer jacket and the rifling. In an embodiment, the polymer jacket can comprise a plurality of thin driving bands spaced along the bullet body to define a plurality of gaps between the driving bands. In this configuration, the spaced driving bands sufficiently engage the barrel walls and rifling to provide the necessary seal and spin, while reducing the overall contact area to reduce the friction between the bullet and barrel. In another aspect, the polymer jacket can comprise a single thick driving band with a larger contact area with the barrel walls and rifling. In this configuration, the larger contact area permits a more effective seal between the bullet and the barrel. As the driving bands are molded, the number and dimensions of the driving bands can be configured during manufacture according to the intended application of the bullet or the needs of the consumer.

In an embodiment, the polymer jacket can comprise at least one molded ballistic element that improves the ballistic or firing characteristics of the bullet. In an embodiment, the molded ballistic element can comprise an obturation skirt portion defining a rearward facing cup portion at the rear of the bullet to capture propellant gases generated by the ignited propellant charge. The cup portion is shaped to deform and expand radially outward as the propellant gases contact the obturation skirt, such that the obturation skirt engages the barrel to seal the bullet to the barrel. In another aspect, the ballistic element can comprise a molded boat tail for reducing the drag of the jacketed bullet in flight, which improves the overall ballistic characteristics of the bullet. The boat tail of the polymer jacket can be molded onto a bullet body with an existing boat tail. Alternatively, the boat tail of the polymer jacket can be molded over a conventional cylindrical tail bullet to improve the ballistics of the conventional bullet.

In an embodiment, the bullet body can comprise a frustotapered head portion and a cylindrical tail portion. In this configuration, the bullet body can define an axial well cavity within the frustotapered head portion. The axial well cavity facilitates the mushrooming of the head portion of the bullet up on impact. In an embodiment, the jacketed bullet can further comprise a tip insert having a tapered head portion and an elongated tail portion receivable within the well cavity. The tapered head portion aligns with the frustotapered head portion of the bullet body when the tail portion is inserted into the well cavity to improve the aerodynamic characteristics of the jacketed bullet. In this configuration, the tip insert and the polymer jacket combine to encase the bullet body.

A bullet, according to an embodiment of the present invention, can comprise a bullet body and a radially deforming polymer component. In an embodiment, the radially deforming component can comprise a cup defining a well cavity. The bullet can further comprise a generally tapered head portion and a cylindrical tail portion, wherein the tail portion is movable within the well cavity in response to an axial force applied the bullet between an extended position in which the tail portion protrudes from the well cavity and a retracted position in which the tail portion is fully seated within the projectile. The cup can define a reduced diameter portion of the well cavity engageable by the tail portion as the tail portion is pressed into the retracted position. The cup can also define a deformable portion at the reduced diameter portion that expands radially outward as the tail portion engages the reduced diameter portion to seal the cupped bullet against the inner wall of barrel and engage the cup to the rifling of the barrel.

In another aspect, the radially deforming component can comprise a polymer obturation skirt engageable to the rear of the bullet body. In this configuration, the bullet body can further comprise a tapered head portion and a boat tail. The boat tail is contoured to provide a generally frustoconical shaped tail portion of the bullet. The obturation skirt can further comprise a cup portion having at least one wall defining a cup cavity for receiving the boat tail of the bullet. In an embodiment, the inner face of the wall can be angled to correspond to the contour of the boat tail.

In operation, the obturation skirt is movable axially relative to the boat tail between a pre-fired position and a fired position in which the obturation skirt is moved forward axially relative to the boat tail by the generated propellant gases. The forward motion of obturation skirt presses the walls of the cup portion against the boat tail, wherein the boat tail acts as a camming surface pressing the walls of the cup portion radially outward to engage the walls and rifling of the barrel. Alternatively, the obturation skirt can be braced against the propellant charge during loading. An axial force can be applied to the bullet with the ramrod to push boat tail against walls of the obturation skirt, which is braced against the propellant charge, to force the walls radially outward into engagement with the walls and rifling of the barrel.

In another aspect, the radially deforming component can comprise a polymer jacket having at least one molded driving band. The bullet body can further comprise a generally tapered head portion and a cylindrical tail portion. Each driving band extends circumferentially around the cylindrical tail portion. In an embodiment, the polymer jacket can comprise a plurality of driving bands spaced along the cylindrical tail portion to define a plurality of gaps between the driving bands. In another aspect, the polymer jacket can comprise a single driving band extending axially over the entire cylindrical tail portion of the bullet body.

A method of loading a bullet into a muzzleloader, according to an embodiment of the present invention, comprises providing a bullet having a tail portion positioned within a well cavity of a cup, wherein the tail portion is moveable within the well cavity between an extended position and a retracted position. The method further comprises loading the cupped bullet into the muzzle of the barrel, wherein the cupped bullet is loaded with the tail portion in the extended position. The method also comprises applying an axial force to the cupped bullet until the cupped bullet is positioned in the breech end of the barrel. The method further comprises applying additional axial force to push the tail portion into the retracted position within the well cavity, wherein the tail portion engages the cup as the tail portion is pushed into the retracted position to cause radially expansion of a portion of the cup.

A method of manufacturing a jacketed bullet comprises providing a bullet body having a frustotapered head portion and a cylindrical tail portion. The method also comprises inserting a tail portion of a tip insert into the well cavity, wherein the tail portion comprises a tapered head portion that cooperates with frustotapered head portion to define a generally conical body. The method further comprises over-molding a polymer jacket onto the bullet body, wherein the tip insert and the polymer jacket cooperate to cover the exterior of the bullet body. The method can also comprise molding at least one driving band on the polymer jacket, wherein the driving band extends circumferentially around the cylindrical tail portion of the bullet body. In an embodiment, the method can further comprise molding at least one molded element onto the polymer body selected from the group of an obturation skirt, a boat tail, or combinations thereof.

In an embodiment of the present invention, the bullet body comprises a tip insert having a tip tail portion receivable within an axial bullet well cavity. The tip tail portion is loaded into the barrel in an extended position in which the tip tail portion partially extends from the bullet well cavity. Upon seating against the propellant charge, an increased axial force can be applied to the tip insert to move the tail portion into a retracted position in which the tail portion is fully seated within the bullet well cavity. The movement of the tip tail portion from the extended position to the retracted position provides a tactile indication to the user through the ramrod that the bullet is properly seated against the propellant charge.

In an embodiment, the tip tail portion defines a circumferential protrusion that engages the edges of the bullet well cavity to maintain the tail portion in the extended position as the bullet is pushed down the barrel with the ramrod until the bullet is seated against the propellant charge. The circumferential protrusion is sized to prevent the tip tail portion from moving into the retracted position in response to the axial force applied to the tip insert with the ramrod to overcome the friction between the bullet and the barrel and move the bullet through barrel. The axial force as the bullet is pushed down the barrel is limited to the force necessary to overcome the friction between the bullet and the barrel. Upon seating of the bullet against the propellant charge, sufficient axial force can be applied with the ramrod to deform the circumferential protrusion and disengage the circumferential protrusion from the edge of the well cavity allowing the tip tail portion to move into the retracted position.

In an embodiment, the bullet can further comprise a collar portion at the mouth of the bullet defining a reduced diameter portion engageable to the tip tail portion of the tip insert. In this configuration, the tip tail portion defines a first notch positioned to engage the reduced diameter portion when the tail portion is position in the extended position. The engagement of the reduced diameter portion to the first notch maintains the tip tail portion in the extended position until the bullet is seated against the propellant charge. In an embodiment, the tip tail portion can further comprise a second notch positioned to be engageable by the reduce diameter portion when the tip tail portion is moved into the retracted position so as to maintain the tip tail portion in the retracted position as the bullet travels down the barrel and in flight.

In an embodiment, the tip insert can define a generally tapered head portion that aligns with the contours of the bullet exterior when the tail portion is moved into the retracted position to provide an aerodynamic shape for improved ballistic performance. In another aspect, the tip insert can comprise a rigid polymer or other frangible material adapted to fracture upon impact with the target. In this configuration, the bullet well cavity operates as a hollow point tip facilitating mushrooming of the bullet upon impact to increase the damage to the target caused by the bullet.

A bullet, according to an embodiment of the present invention, can define a bullet well cavity and comprise a tip insert having a tip tail portion. The tip tail portion is movable within the bullet well cavity between an extended position and a retracted position in response to an axial force applied to the tip insert. In an embodiment, the tip tail portion further comprises a circumferential protrusion positioned to engage the edge of the bullet well cavity when the tip tail portion is positioned in the extended position. In another aspect, the bullet can further comprise a collar portion at the mouth of the bullet well cavity having a reduced diameter portion engageable to the tail portion. In this configuration, tip tail portion defines a notch positioned to engage the reduced diameter portion when the tip tail portion is positioned in the extended position.

A bullet, according to an embodiment of the present invention, can comprise a bullet body having a tapered head portion defining a proximal end, a cylindrical tail portion defining a distal end and an outer body surface. The bullet body can further comprise a first circumferential outer groove positioned between the tapered head portion and the cylindrical tail portion. The bullet can comprise a deforming polymer component comprising a first polymer band extending circumferentially around the bullet body in the first circumferential outer groove, wherein a portion of the first polymer band extends radially beyond the outer body surface of the bullet body. In an aspect of the invention, the first polymer band comprises an elastomeric material. In another aspect, the first circumferential outer groove is at the bourrelet of the bullet body.

In a further aspect, the bullet body further comprises a second circumferential outer groove positioned between the tapered head portion and the cylindrical tail portion. The deforming polymer component can comprise a second polymer band extending circumferentially around the bullet body in the second circumferential outer groove, wherein a portion of the second polymer band extends radially beyond the outer body surface of the bullet body.

In another aspect of the invention, the deforming polymer component comprises a polymer skirt extending circumferentially around the bullet body in the first circumferential outer groove, wherein a portion of the first polymer band extends radially beyond the outer body surface of the bullet body to an extent that a circumferential portion of the polymer skirt may extend distally along the outer surface of the bullet body. In an aspect, in a resting state, the circumferential portion of the polymer skirt extends distally along the outer surface of the bullet body past the distal end of the bullet body. In a further aspect, in a resting state, the circumferential portion of the polymer skirt extends distally along the outer surface of the bullet body to a point no further than a point proximal of the distal end of the bullet body. In still a further aspect, in its resting position, the polymer skirt is not form fitting along its length to the bullet body.

A method of loading a muzzleloader bullet, according to an embodiment of the present invention, comprises providing a bullet having a tip insert comprising a tip tail portion movable within a bullet well cavity defined by the bullet between an extended position and a retracted position. The method further comprises loading the bullet into the barrel of the muzzleloader in the extended position and applying an axial force to bullet to move the bullet to the breech end of the barrel, wherein the bullet defines a reduced diameter portion engageable to the tip tail portion to maintain the tail portion in the extended position as the bullet is pushed down the barrel. The method also comprises seating the bullet against a propellant charge in the breech end and applying an additional axial force to the tip insert to move the tip tail portion into the retracted position.

In an embodiment of the invention, a bullet system comprising a metal bullet body with forward tip, a rearward end surface and a side surface, the side surface having a circumferential indentation, and a polymer cup secured to the side surface of the bullet body at the circumferential indentation, the cup having an open end defining a cup mouth with a periphery, the cup. In an embodiment the cup comprises a skirt portion that extends axially rearward from the circumferential indentation beyond the rearward end surface of the bullet body and expands radially outwardly under pressurization when fired from a firearm with a propellant. In an embodiment the skirt portion opens rearwardly.

A bullet for muzzleloaders, according to an embodiment of the present invention, comprises a bullet body having a tapered head portion defining a proximal end, a cylindrical tail portion defining a distal end and an outer body surface. The bullet body further comprises a first circumferential outer groove positioned between the tapered head portion and the cylindrical tail portion. The bullet further comprises a deforming polymer component comprising a first polymer band extending circumferentially around the bullet body in the first circumferential outer groove, wherein a portion of the first polymer band extends radially beyond the outer body surface of the bullet body. In a further aspect, the bullet body further comprises a second circumferential outer groove positioned between the tapered head portion and the cylindrical tail portion; and the deforming polymer component comprises a second polymer band extending circumferentially around the bullet body in the second circumferential outer groove, wherein a portion of the second polymer band extends radially beyond the outer body surface of the bullet body.

In an embodiment, a bullet system comprising a bullet body and a polymer cup engaged therewith, the bullet body and engaged polymer cup having an axial expanded position and axial shortened position, the bullet having a forward tapered end and a rearward tail portion, a cup engaged with the rearward tail portion at a first position, the cup having a radially deformable portion that is positioned rearwardly of the increased radius portion of the tail portion when the bullet and engaged polymer cup are in the expanded position, whereby when the cup is moved forwardly on the bullet body to the shortened position, the radially deformable portion moves to the increased radius portion of the tail portion and radially deforms outwardly.

Further embodiments are as follows:

A projectile for a muzzleloader comprising a metal bullet body having a tapered forward end and a tail portion and a polymer component engaged therewith and being coaxial therewith, the metal bullet body and polymer annular component having cooperating axially extending surfaces where the component is axially shiftable with respect to the bullet body whereby the bullet has an axial elongated position and an axial shortened position.

The projectile above wherein the cooperating surfaces are annular and concentric.

The projectile above wherein the component is configured as a cup with an open end and a closed end and the cup is attached to the tail portion of the bullet body at a tapered portion, whereby when the component shifts axially, a deformable portion of the cup rides up the tapered portion effecting a radial expansion of the component.

The projectile above wherein the component is radially inward from the bullet body and is engaged in central recess, the component having a pointed end defining the forward point of the bullet, the component seatable into the recess of the bullet body when axially compressed thereby axially shortening the projectile.

A projectile for a muzzleloader comprising a metal bullet body having a tapered forward end and a tail portion and a polymer component engaged therewith and being coaxial therewith, the metal bullet body and polymer annular component having cooperating axially extending surfaces where the component is axially shiftable with respect to the bullet body presenting an axially elongated position and an axially shortened position, and wherein at the axially shortened position the projectile has an increased radius compared to the axially elongated position.

The projectile above wherein the projectile is insertable into the muzzleloader in the axially elongated position and wherein pressure from firing the muzzleloader is sufficient to shift the projectile to the axially shortened position.

The projectile above wherein the component comprises a rearwardly facing circular cutting edge sized for scraping the barrel of the muzzleloader when the projectile is loaded into the muzzleloader.

A projectile for a muzzleloader, the bullet system comprising a forward bullet body and a rearward polymer cup, the cup has a rearwardly facing cutting surface extending around the cup at a rearward end of the cup sized to scrape the barrel when loaded into muzzle loader.

A method of cleaning a muzzleloader and comprising scraping the barrel of the muzzleloader by insertion of the projectiles above.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1A:
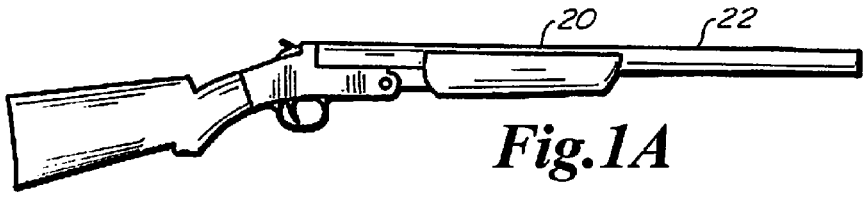
FIG. 1A is an elevational view of a muzzleloader shown in cross-section in FIGS. 1B-4 illustrating embodiments of the invention.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Figure 1B:
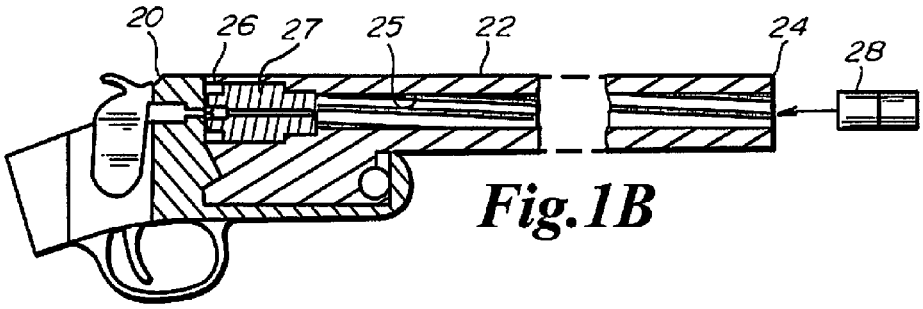
FIG. 1B is a cross-sectional side view of a muzzleloader for use with the present invention.
Figure 2:
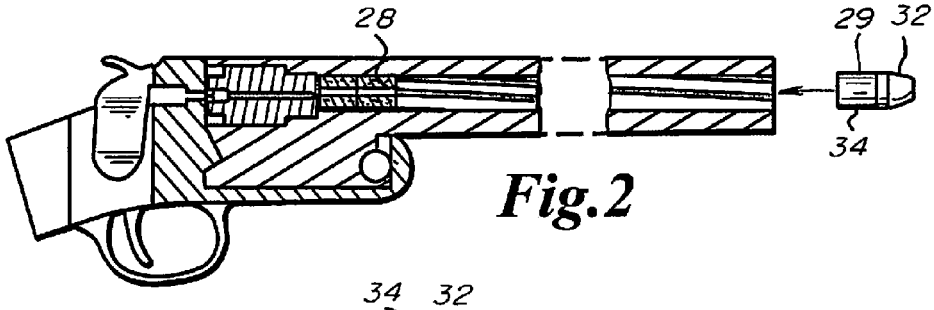
FIG. 2 is a cross-sectional side view of a muzzleloader with a propellant charge positioned at a breech end of the barrel and a conventional bullet positioned at a muzzle end of the barrel.
Figure 3:
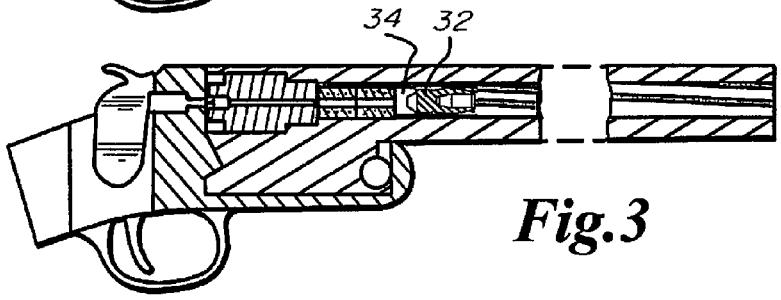
FIG. 3 is a cross-sectional side view of the muzzleloader depicted in FIG. 2, with the conventional bullet pushed partially through the barrel with a ramrod.
Figure 4:
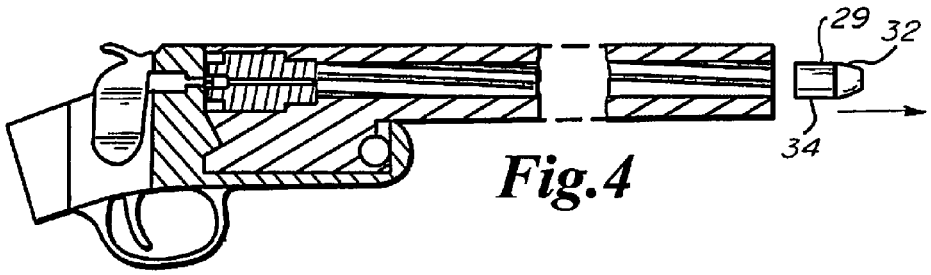
FIG. 4 is a cross-sectional side view of the muzzleloader depicted in FIG. 2 with the conventional bullet being fired.

As depicted in FIGS. 1A-5, a muzzleloader 20, for use with the present invention, generally comprises a barrel 22 having a muzzle 24, a breech end 26 with a breech plug 27 therein. The barrel 22 can comprise smooth bore or a rifled bore 25 as depicted in FIG. 1. As depicted in FIGS. 2-4, the muzzleloader 20 may be conventionally loaded by loading a propellant charge 28 through the muzzle 24 of the barrel 22 and pushing the propellant charge 28 toward the breech end 26 of the barrel 22. A projectile 29, with a bullet, and a shiftable cup 34 on the tail of the bullet, according to the invention is positioned in the muzzle 24 of the barrel 22 before being pushed down the barrel 22 with the ramrod until the bullet is seated against the propellant charge 28 As shown in FIG. 3. The muzzleloader is then ready to be fired and the is in an axially elongated state. FIG. 4 illustrates the muzzleloader after the bullet has been fired, the bullet in an axially retracted or compressed state and with an expanded circumference.

Figure 12C:
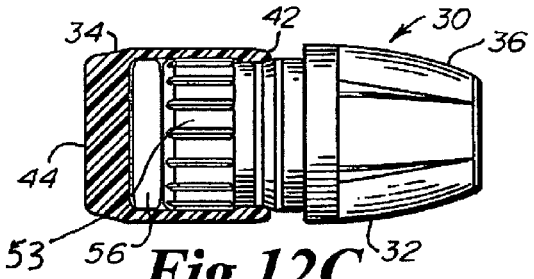
FIG. 12C is a cross sectional view of a bullet in an axial expanded state.

Referring to FIGS. 5-12C, embodiments of bullets 30 according to the invention, are illustrated and generally comprise a bullet body 32 and a radially deforming polymer component configured as a cup 34. The bullet body 32 comprises a forward tapered end configured as a tapered head portion 36 and a generally cylindrical tail portion 38. The cup 34 defines a well cavity 40 having a forward open end 42, a rearward closed end 44, a tubular portion 41, and a disc portion 43. The tail portion 32 of the bullet body is movable axially within the open end 42 of the well cavity 40 between an axially elongated, extended, or expanded position depicted in FIGS. 5-8 and 9C-9D, in which a portion of the tail portion 38 is exposed at the open end 42 of the well cavity, and an axially shortened, retracted or collapsed position or state as depicted in FIGS. 9A, 9B and 13 in which the tail portion 38 is fully seated within the cup 34. The tail portion 38 is movable from the expanded or extended position into the retracted position in response, for example, by an axial force applied to the tip of the bullet body 32 with the ramrod during loading. Alternately, the cup is movable from the expanded or extended position to a compressed or retracted position by a forced applied to the closed end 44 of the cup when the bullet is seated in the barrel and a propellant is discharged.

As best depicted in FIGS. 5, 6, 8, 10, in embodiments of the invention, the cup 34 has a inward lip a reduced diameter portion 46 at the closed end 44 of the well cavity 40. As the tail portion 38 is moved into the retracted or collapsed position, the tail portion 38 engages the reduced diameter portion 46. In this configuration, the cup 34 comprises a deformable portion 48 proximate to the reduced diameter portion 46, wherein engagement of the tail portion 38 to the reduced diameter portion 46 causes the deformable portion 48 to expand radially outward to engage the barrel. In an embodiment, the tail portion 38 further comprises a foot portion 50 having an increased radial diameter to further increase the radial expansion of the deformable portion 48 as the tail portion 38 is moved into the axial shortened or retracted position or state. The tail portion 38 can define a plurality of axial grooves 52 in the foot portion 50 defining segments 53 that grip the cup for torque transmission from the cup as it engages the rifling to the bullet body.

In an embodiment, the cup 34 can comprise a polymer material including, but not limited to nylon, polyethylene and polypropylene. In certain aspects, the polymer material can be opaque or translucent. In another aspect, the polymer material can include a friction reducing additive or be formed of fluoropolymers. Generally the cup will be homogeneous such that all portions of the cup may be deformable, however, particular portions may have structure, a thin wall for example, or modifications, such as indentations or scoring, to enhance the deformability, particularly radial deformation. The cup is amenable to being injection molded.

Figure 12A:
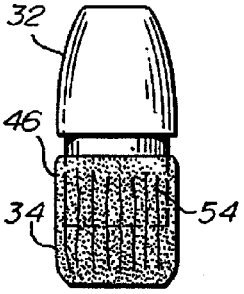
FIG. 12A is an elevational view of a bullet in an expanded state.
Figure 12B:
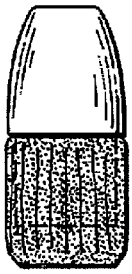
FIG. 12B is an elevational view of the bullet of FIG. 12A in the axial shortened radially enlarged state.
Figure 13:
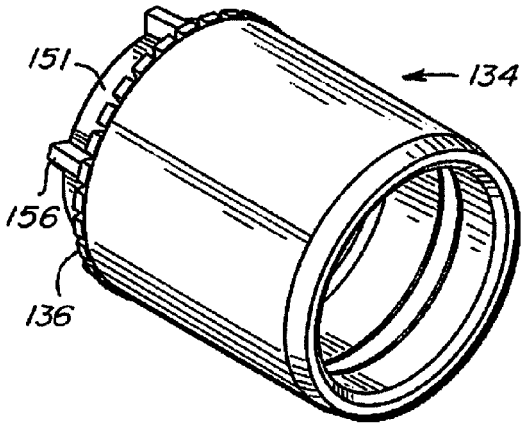
FIG. 13 is a perspective view of a cup sabot according to an embodiment of the invention.

As depicted in FIGS. 12A-12B, in an embodiment, the cup 34 may comprise circumferential axial scoring 54 on the exterior of the cup 34 at the deformable portion 48 to provide even radial expansion of the cup 34. The axial scoring 54 facilitates even radial expansion of the deformable portion 48 as the tail portion 38 engages the reduced diameter portion 46.

As depicted in FIG. 12C, in an embodiment of the present invention, the cup 34 can comprise a disc 56 positioned at the closed end 44 of the well cavity 40. The disc 56 comprises incompressible material, that is, fixed volume material, such that moving the tail portion 38 into the retracted position applies an axial force to the disc 56 causing the disc 56 to expand radially outward pushing against the deformable portion 48 of the cup 34, which in turn causes the deformable portion 48 to expand radially outward to engage the barrel 22. In an embodiment, the disc 56 used in conjunction with the reduced diameter portion 46 to facilitate radial expansion of the deformable portion 48.

The cupped bullet 30 is loaded by positioning the cupped bullet 30 in the muzzle 24 of the barrel 22 and pushing it or ramming it down the barrel 22 with the ramrod until seated against a propellant charge 28 in the breech end 26 of the barrel 22. In an embodiment, the outer diameter of the cup 34 approximates the inner diameter of the lands of the barrel rifling such that the cupped bullet 30 can be loaded down the barrel 22 with minimal friction between the bullet 30 and the barrel 22. Upon seating against the propellant charge 28, in one embodiment, continued axial force is applied to the cupped bullet 30 with the ramrod to move the tail portion 32 into the retracted position and radially expanding the cup 34 to engage the barrel 22.

Figure 5:
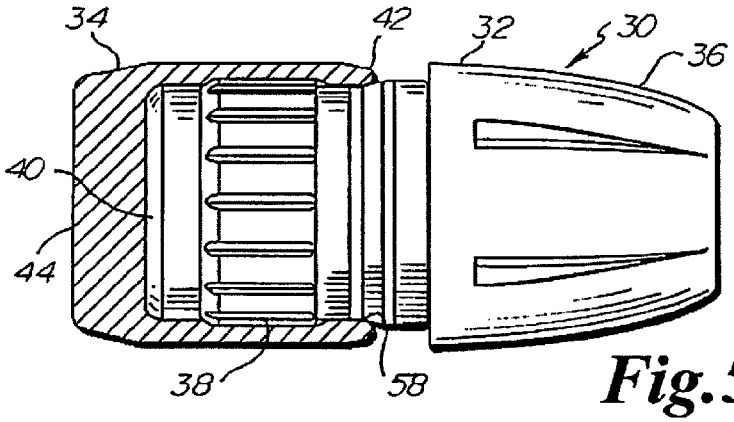
FIG. 5 is a cross-sectional side view of a cupped bullet according to an embodiment of the present invention.
Figure 6:
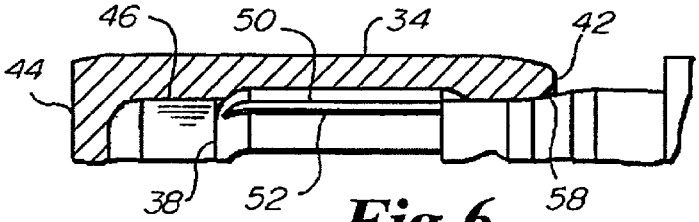
FIG. 6 is a partial cross-sectional side view of a portion the cupped bullet depicted in FIG. 5.
Figure 7:
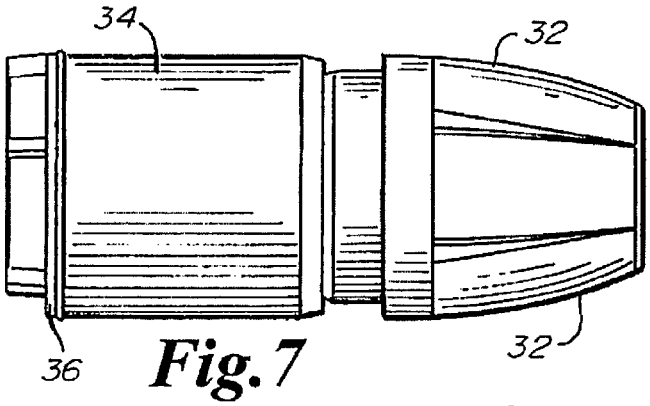
FIG. 7 is a cross-sectional side view of a muzzleloader barrel with a propellant charge positioned at a breech end of the barrel and a cupped bullet, according to an embodiment of the present invention, positioned at a muzzle end of the barrel.
Figure 8:
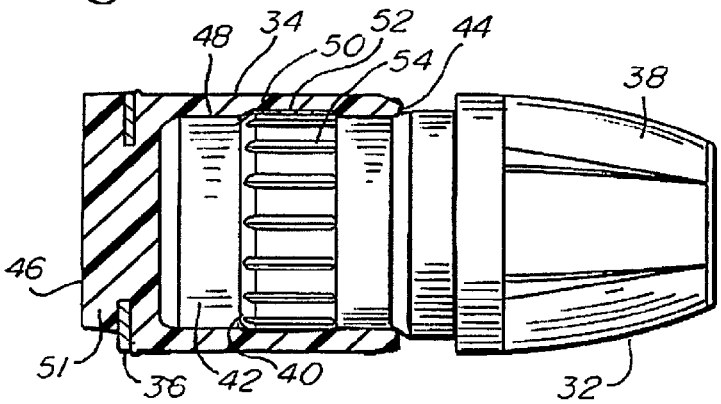
FIG. 8 is a cross-sectional side view of the muzzleloader barrel depicted in FIG. 7, with the cupped bullet pushed partially through the barrel with a ramrod.
Figure 10:
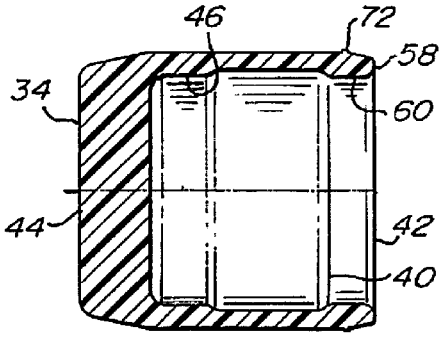
FIG. 10 is a cross-sectional side view of a cupped bullet according to an embodiment of the present invention.

As depicted in FIGS. 5-6 and 10, in one embodiment, the cup 34 further comprises a collar portion 58 defining a second reduced diameter portion 60 at the open end 42 of the cup 34. In this configuration, the tail portion 38 defines a notch 62 engageable by the second reduced diameter portion 60 when the tail portion 38 is positioned in the extended position. The engagement of the notch 62 by the second reduced diameter portion 60 maintains the tail portion 38 in the extended position as the cupped bullet 30 is pushed down the barrel 22 until the cupped bullet 30 is seated against the propellant charge 28. The propellant charge 28 braces' the cupped bullet 30 permitting sufficient axial force to be applied to cupped bullet 30 to disengage the second reduced diameter portion 60 from the notch 62. This can be by utilizing a ram rod in one instance and utilizing the force from the ignited propellant in another instance. In an embodiment, the notch 62 can have a increasing radius portion configured as a sloped face 64 to facilitate disengagement of the second reduced diameter portion 60 and to radially deform the radially deformable cup. In another aspect, the collar portion 58 can further comprise a molded driving band 72 extending radially outward from the cup 34. The driving band 72 is adapted to engage the walls and rifling of the barrel 22 with the deformable portion 58 to maintain the axial alignment of the bullet 30 as the bullet 30 travels down the barrel 22.

Figure 9A:
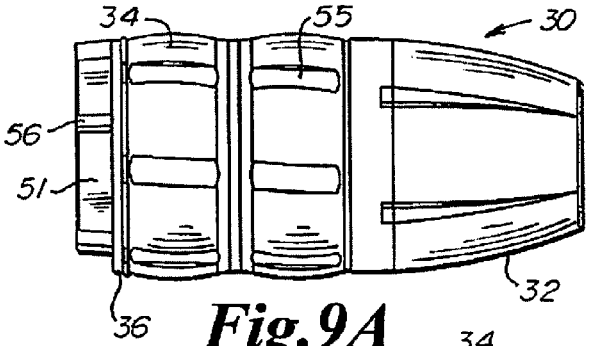
FIG. 9A is a cross-sectional side view of the muzzleloader barrel depicted in FIG. 7 with the cupped bullet seated against the propellant charge in the breech end of the barrel and a portion of the cupped bullet expanded radially outward to engage the rifling of the barrel.
Figure 9B:
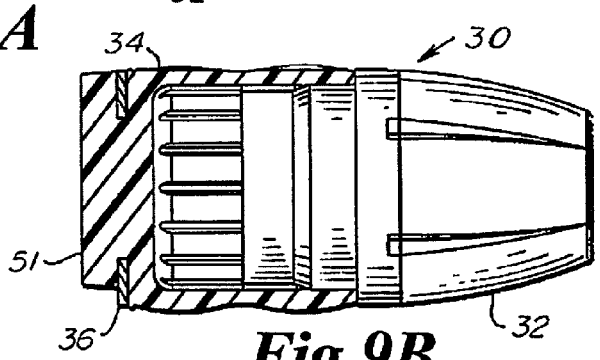
FIG. 9B is a perspective view of a cupped bullet in the extended position according to an embodiment of the present invention.
Figure 9C:
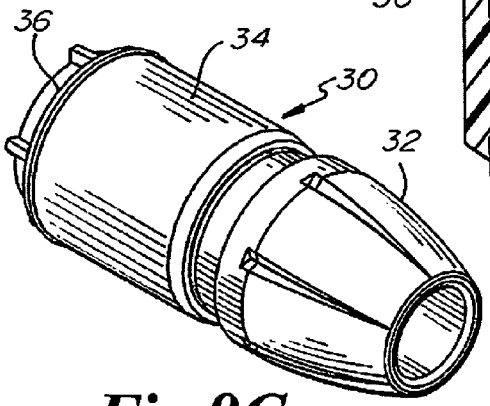
FIG. 9C is a perspective view of a cupped bullet in the retracted position according to an embodiment of the present invention.
Figure 9D:
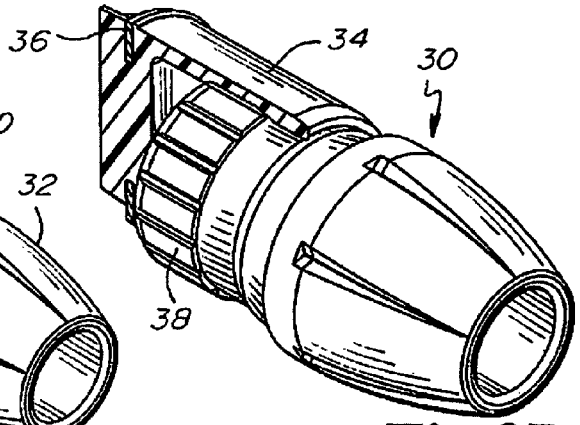
FIG. 9D is a perspective view of a cupped bullet in the retracted position according to an embodiment of the present invention.
Figure 9E:
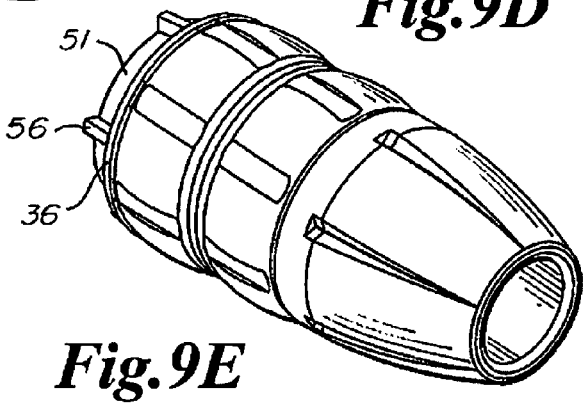
FIG. 9E is a rear perspective view of a bullet according to an embodiment of the present invention.
Figure 11C:
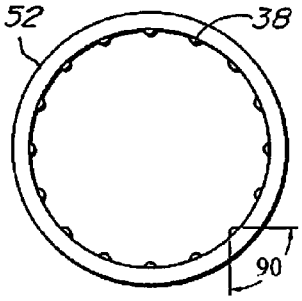
FIG. 11C is a rear view of the bullet body depicted in FIG. 15.
Figure 11A:
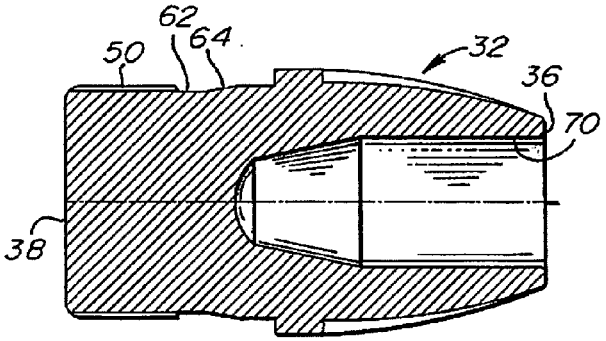
FIG. 11A is a cross-sectional side view of a bullet body according to an embodiment of the present invention.
Figure 11D:
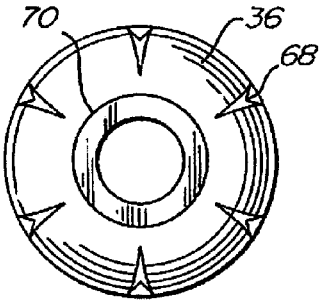
FIG. 11D is a front view of the bullet body depicted in FIG. 15.
Figure 11B:
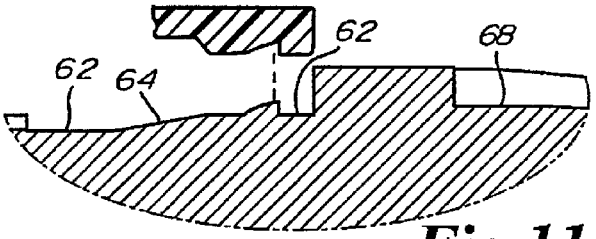
FIG. 11B is an enlarged cross-sectional side view of a portion of the bullet body depicted in FIG. 15.

As depicted in FIGS. 9C-9D and 12A-12B, the cup 34 is shaped to follow the contour of the tapered head portion 36 of the bullet body 32 when the tail portion 38 is positioned in the compressed or retracted position to eliminate or minimize gaps between the open end 42 of the cup 34 and the edge of the tapered head portion 36 of the bullet body 32. In an embodiment, the cup 34 is non-discarding such that the cup 34 travels with the bullet body 32 through its flight. The smooth, gapless mating of the cup 34 and the tapered head portion 36 improves the aerodynamic properties of the cupped bullet 30 in flight. As depicted in FIGS. 5-6 and 9E, in this configuration, the tail portion 38 can define a annular or discrete tabs 65 that define second notch 66 engagable by the second reduced diameter portion 60 when the tail portion 38 is positioned in the compressed or retracted position to maintain the cupped bullet 30 in the compressed or retracted position as the cupped bullet 30 leaves the muzzle 24 and in flight. As depicted in FIG. 5, the tapered head portion 36 of the bullet body 32 can further comprise score lines 68 shaped to facilitate mushrooming of the tapered head portion 36 upon impact with the target. As depicted in FIGS. 11A and 11B, the tapered head portion 36 can define an axial well cavity 70 that opens upon impact to mushroom the tapered head portion 36 upon impact with the target.

A method of loading a cupped bullet 30 into a muzzle-loader 22, according to an embodiment of the present invention, comprises providing a bullet body 32 having a tail portion 38 positioned within a well cavity 40 of a cup 34, wherein the tail portion 38 is moveable within the well cavity 40 between an extended position and a retracted position. The method further comprises loading the cupped bullet 30 into the muzzle 24 of the barrel 22, wherein the cupped bullet 30 is loaded with the tail portion 38 in the extended position. The method also comprises applying an axial force to the cupped bullet 30 until the cupped bullet 30 is seated toward the breech end 26 of the barrel 22. In one embodiment, the method further comprises applying additional axial force to push the tail portion 38 into the compressed or retracted position within the well cavity 40, wherein the tail portion 38 fully seats within the cup 34 as the tail portion 38 is pushed into the retracted position to cause radially expansion of a portion of the cup 34. In this embodiment, the bullet and cup are configured to resist compression until about 10 pounds of axial force is applied. In another embodiment, 20 pounds, in another embodiment 5 pounds.

In another embodiment, the cup and bullet body are configured to preclude the compression of the cup and bullet body as the bullet is rammed into the barrel. In such embodiment, the cup and bullet body are configured to resist compression up to 300 pounds of axial force. In another embodiment, up to 250 pounds. In another embodiment, up to 350 pounds.

As depicted in FIGS. 7-9E, a bullet 30, according to an embodiment of the present invention, comprises a bullet body 32 and a radially deforming polymer component comprising a cup 34 having a radial cutting ring 36. The cup 34 can be made of injection molded polyethylene or other suitable polymers. The radial cutting ring 36 can be insert molded or press fit onto the cup 34, and can be made of copper, steel, or other metals, or carbon fiber or other suitable polymers, particularly polymers with fillers or surface coatings. The converging tail section 51 also includes ribs 56, which inhibit rotation between the cup 34 and bullet body.

As depicted in FIGS. 13-16, in an embodiment, cup 134 can include a toothed radial cutting ring 136. The toothed radial cutting ring 136 can include an annular ring portion 158 and a plurality of teeth 160 extending radially therefrom. The teeth 160 can provide improved barrel fouling removing capabilities in certain applications.

Figure 14:
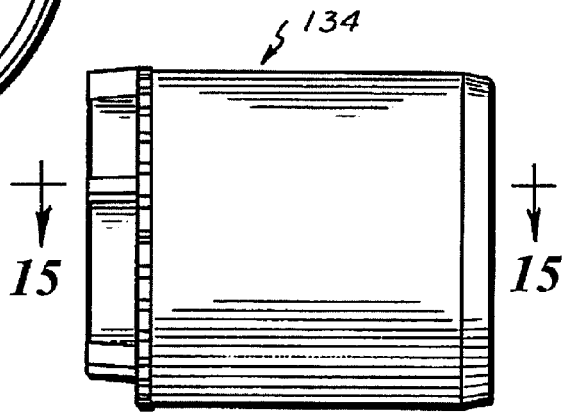
FIG. 14 is a side elevational view of the cup sabot of FIG. 13.
Figure 15:
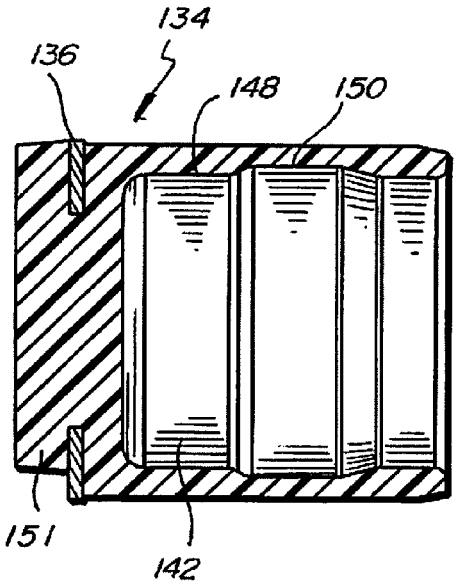
FIG. 15 is a cross-sectional view of the cup sabot of FIG. 13 taken along line A-A.
Figure 16:
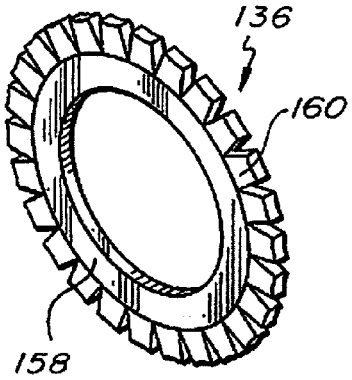
FIG. 16 is a perspective view of a radial cutting ring according to an embodiment of the invention.
Figure 17A:
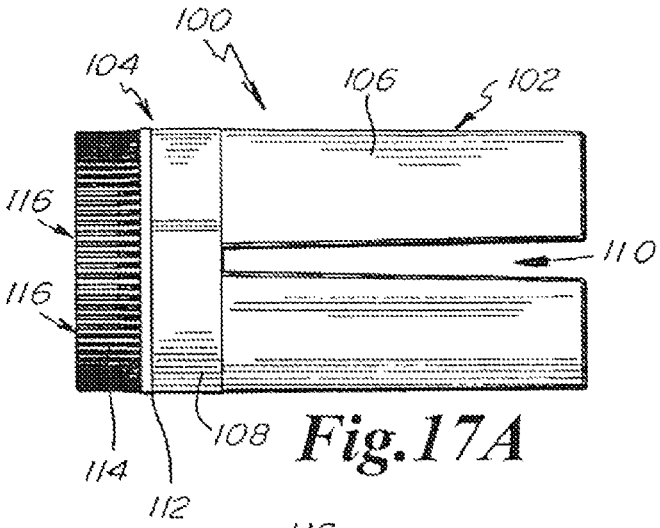
FIG. 17A is a side elevational view of a cup sabot according to an embodiment of the invention.
Figure 17B:
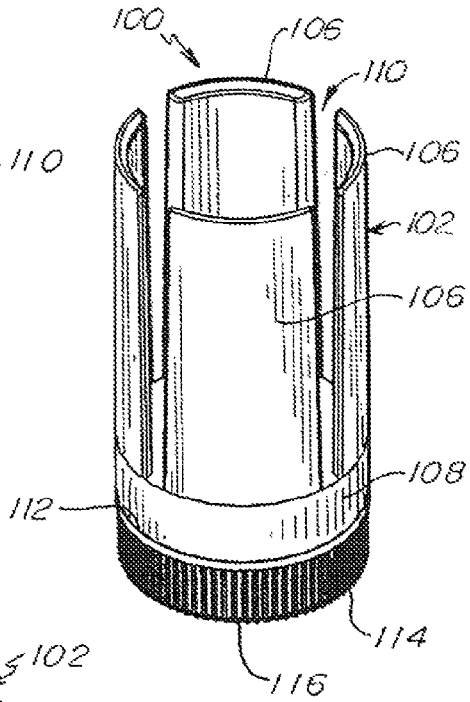
FIG. 17B is top perspective view of the cup sabot of FIG. 17A.
Figure 17C:
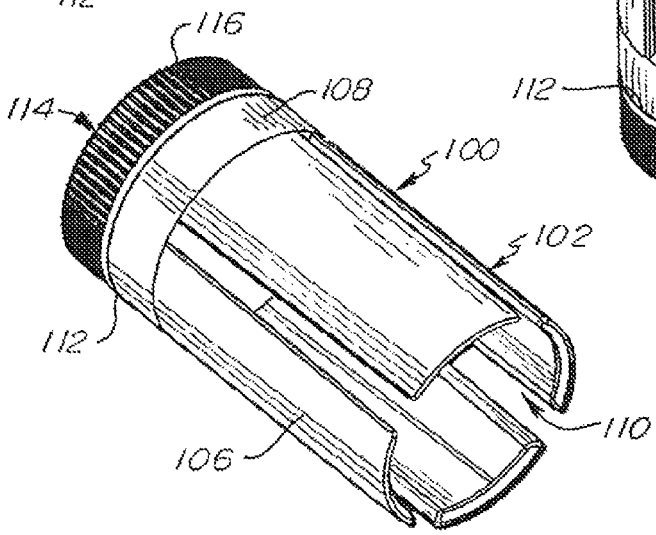
FIG. 17C is a perspective view of the cup sabot of FIG. 17A.

As depicted in FIGS. 13-15, in an embodiment, cup 234 can include a plurality of petals 262 positioned to define the cup. As the bullet is fired, the petals 262 of cup 234 are subjected to a centrifugal force that causes the petals to open, thereby disengaging the cup 234 from the bullet.

Referring to FIGS. 14A-14C, an embodiment of a cup configured as a base sabot 100 of the claimed invention is depicted. Sabot 100 includes circumferentially segmented body portion 102 and base portion 104.

Body portion 102 may comprise a polymer material such as those described above, and in an embodiment includes a plurality of segments or body extensions or petals 106 and main body portion 108. The segments are separated by a plurality of body gaps 110.

Pedals 106 are connected to main body portion 108 and project axially away from main body portion 108. In an embodiment depicted, segmented body portion 102 includes four body extensions 106 and defines four gaps 110. In other embodiments, more or fewer extensions 106 and gaps 110 may be present.

Main body portion 108, in an embodiment, comprises a generally contiguous annular ring adjacent cutting ring 112 and body extensions 106. Main body portion 108 may be joined to body extensions 106 in a variety of ways, including plastic welding, adhesives, and so on. In an embodiment, main body portion 108 and body extensions 106 are molded to form an integrated component.

In an embodiment, base portion 104 includes cutting ring 112 and splined rearward end portion 114. As described above, sabot cutting ring 112 may comprise a rigid ring comprised of a metal or other rigid material. Cutting ring 112 is affixed to rearward end portion 114 and main body portion 108. In an embodiment, cutting ring 112 defines a diameter that is slightly larger than a diameter of main body portion 108 and rearward end portion 114 so as to perform a scraping, clearing, or cleaning function as it is delivered through the barrel.

Rearward end portion 114 comprises a splined, disc-like structure affixed to cutting ring 114. Rearward end portion 114 may comprise any of a variety of materials, including plastics or metal. In an embodiment, and as depicted, rearward end portion 114 defines a plurality of axially-extending channels 116 or splines distributed evenly about the circumference of rearward end portion 114.

In use, cutting ring 112 scrapes an inside surface of a muzzleloader barrel, causing material to build in the vicinity of rearward end portion 114. Channels 116 slow the accumulation of material build-up in the region of rearward end portion 114 and cutting ring 112, such that sabot 100 may more easily be delivered through a muzzleloader barrel.

Additional depictions of sabot 100 are included at page 5 of Appendix A, which is herein incorporated in its entirety.

Figure 18A:
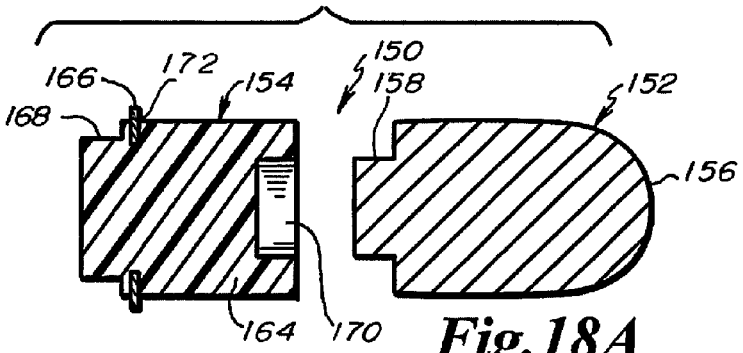
FIG. 18A is a cross-sectional view of a cup-bullet body combination having a removable sabot, according to an embodiment of the invention.

Referring to FIG. 18A, an embodiment of a cupped bullet 150 in cross section is depicted. Cupped bullet 150 includes projectile 152 and removable sabot 154.

Projectile 152 includes body portion 156 and tail portion 158. In an embodiment, a diameter of body portion 156 is greater than a diameter of a tail portion 158. Tail portion 156 projects axially away from body portion 156, and may be coaxial with body portion 156.

Removable sabot 154 includes body portion 164, cutting ring 166 and tail portion 168. Body portion 164 defines projectile receiving cavity 170 and cutting ring cavity 172. Tail portion 168 and cutting ring 166 are substantially similar to tail section 51 and cutting ring 36 as depicted in FIG. 6 and described in detail above.

When assembled tail portion 158 of projectile 152 is inserted into cavity 170 of sabot 154. In an embodiment, tail portion 158 fits tightly into cavity 170, but remains removable without by hand. In another embodiment, tail portion requires removal from cavity 170 using a hand tool. In either embodiment, projectile 152 remains removable or separable from sabot 154.

This separability feature provides additional flexibility that may be advantageous in the field. In an embodiment, projectile 152 may be fired without sabot 154; in another embodiment, sabot 152 may be removably attached to sabot 154 and fired. Depending on the shooter's needs, projectile 152 may be used with and without sabot 154.

Figure 18B:
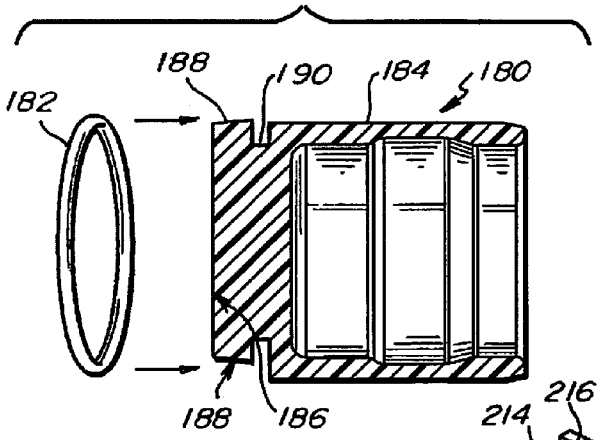
FIG. 18B is a cross-sectional view of a cup having a removable cutting ring, according to an embodiment of the invention.

Referring to FIG. 18B, sabot 180 having optional cutting ring 182 is depicted. In an embodiment, sabot 180 includes body 184 with tapered tail portion 186. Tapered tail portion 186 defines a tapered outer surface 188 and defines cutting-ring receiving cavity 190.

Cutting ring 182 may be added to tapered tail portion 186 by axially aligning cutting ring 182 with tail portion 186 and forcing ring 182 over and along tapered surface 188 until cutting ring 182 seats in cutting ring receiving cavity 190. Once seated into cavity 190, cutting ring 182, in an embodiment, may not be removable.

In an embodiment, sabot 180 may be used with our without cutting ring 182. It may be desirable to attach cutting ring 182 to sabot 180 when using certain powders, or when material begins to build in a barrel. Under some circumstances, and as some might perceive, it may not always be desirable to use a cutting ring.

Figure 19:
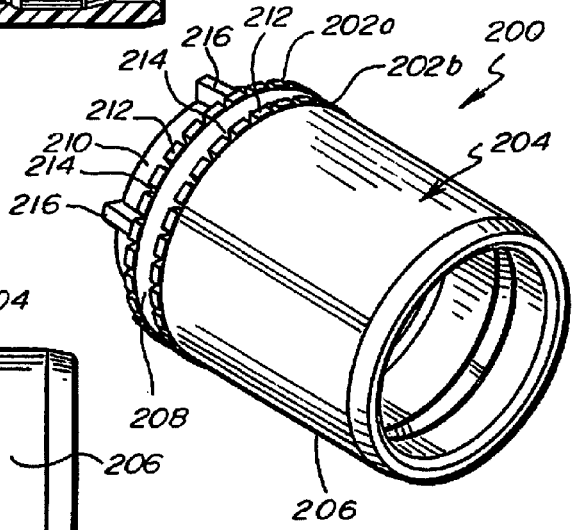
FIG. 19 is a perspective view of a cup having dual cutter rings, according to an embodiment of the invention.
Figure 20:
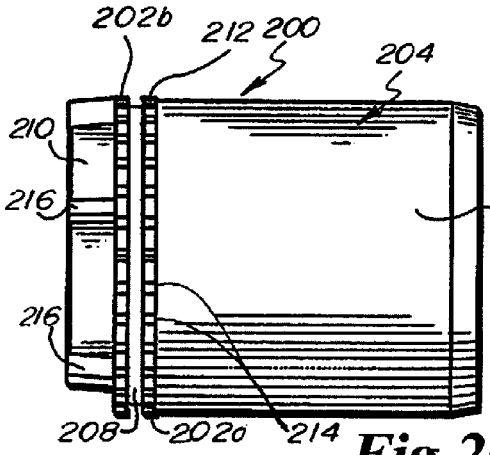
FIG. 20 is a side elevation view of the cup of FIG. 22.
Figure 21:
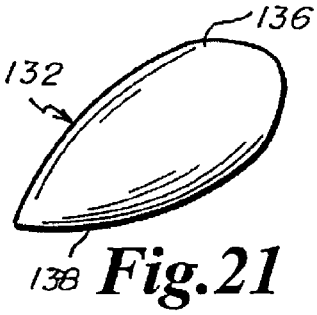
FIG. 21 is a front perspective view of a bullet body according to an embodiment of the present invention.
Figure 23:
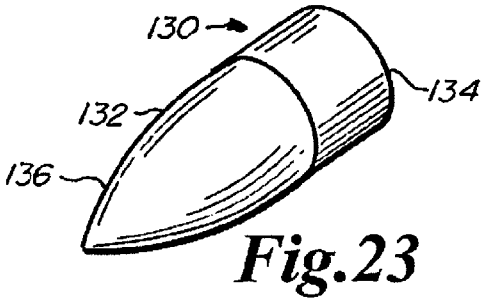
FIG. 23 is a front perspective view of a bullet body and cup according to an embodiment of the present invention.
Figure 22:
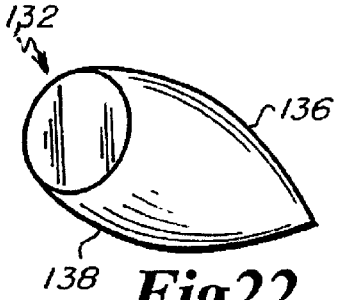
FIG. 22 is a rear perspective view of the bullet body depicted in FIG. 21.
Figure 24:
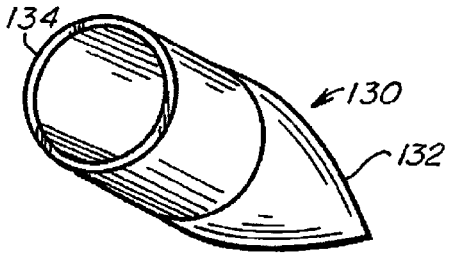
FIG. 24 is a rear perspective view of the bullet body and cup depicted in FIG. 21.
Figure 25:
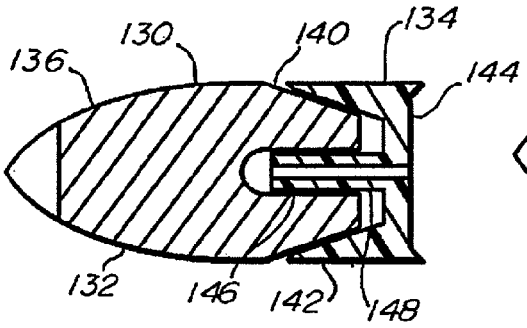
FIG. 25 is a side cross-sectional side view of a bullet according to an embodiment of the present invention, wherein an obturation skirt of the bullet is positioned in the pre-fired position.
Figure 27:
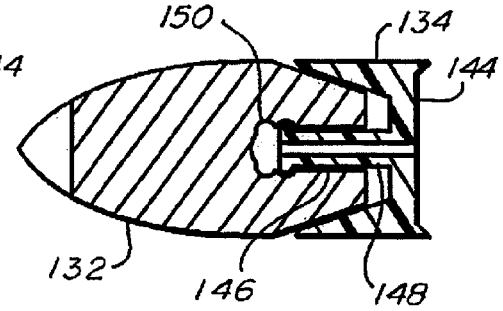
FIG. 27 is a side cross-sectional side view of a bullet according to an embodiment of the present invention, wherein an obturation skirt of the bullet is positioned in the pre-fired position.
Figure 26:
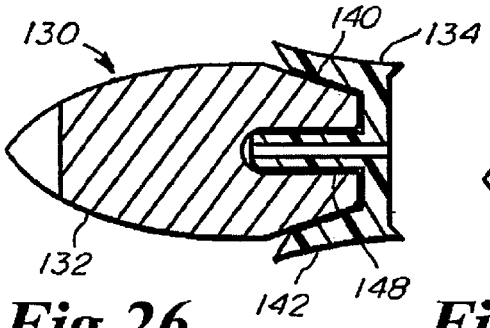
FIG. 26 is a side cross-sectional side view of the bullet depicted in FIG. 25, wherein the obturation skirt is positioned in the post-fired position.
Figure 28:
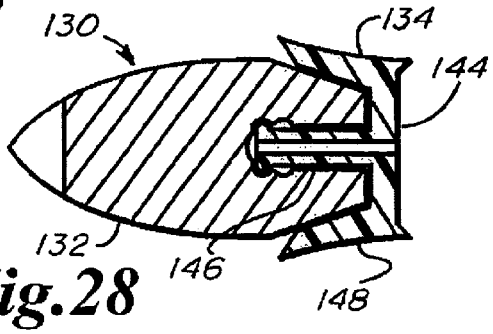
FIG. 28 is a side cross-sectional side view of the bullet depicted in FIG. 27, wherein the obturation skirt is positioned in the post-fired position.

Referring to FIGS. 19 and 20, an embodiment of sabot 200 having dual finger rings 202*a* and 202*b* is depicted.

In an embodiment, sabot 200 includes body portion 204, including a projectile end 206 and tail end 208, and tail portion 210. Tail end 208 of body includes first finger ring 202*a* and second finger ring 202*b*.

Each finger ring 202 includes a plurality of fingers or tabs 212 equidistantly spaced about a circumference of tail end 208, and defining finger gaps 214. Fingers 212 project radially outward from tail end 208 of body portion 204. In an embodiment, an outside diameter of each ring 202 is slightly larger than an outside diameter of body portion 204. Finger ring 202*a* and 202*b* are separated by some distance, with finger ring 202*a* being closer to tail portion 210 than finger ring 202*b*.

Tail portion 210 extends axially away from body portion 204, and defines an outside diameter smaller than body portion 204. Tail portion 210 includes a plurality of axially-extending stabilizing ridges 216 distributed about a circumference of tail portion 210.

When sabot 200 is inserted delivered through a muzzleloader barrel, fingers 212 contact an inside surface of the muzzleloader barrel, and in some embodiments, flexing slightly in an axial direction. The contact of fingers 212 on the barrel causes material accumulated on the barrel inner surface to be removed. Gaps 214 between fingers 212 allow some material to move axially in the barrel, making it easier for sabot 200 to be moved through the barrel. Further, the use of a pair of rings 202*a* and 202*b*, rather than a single finger ring, also increases the ease at which sabot 200 may be delivered in the barrel due to material removed from the barrel being contained in the volume created between finger rings 202*a* and 202*b*, rather than having that material build up behind sabot 200 and interfere with the travel of sabot 200.

Referring again to FIGS. 2-4, a method of loading a cupped bullet 30 into a muzzleloader 22, according to an embodiment of the present invention, comprises providing a bullet body 32 having a tail portion 40 positioned within a well cavity 42 of a cup 34, wherein the tail portion 40 is moveable within the well cavity 42 between an extended position and a retracted position. The method further comprises loading the cupped bullet 30 into the muzzle 24 of the barrel 22, wherein the cupped bullet 30 is loaded with the tail portion 40 in the extended position. As the cupped bullet 30 is pushed down the barrel, radial cutting ring 36 cuts through fouling that has built up inside barrel 22, pushing the barrel fouling around converging tail section 51. The method also comprises applying an axial force to the cupped bullet 30 until the cupped bullet 30 is positioned in the breech end 26 of the barrel 22. The method further comprises applying additional axial force to push the tail portion 40 into the retracted position within the well cavity 42, wherein the tail portion 40 engages the cup 34 as the tail portion 40 is pushed into the retracted position to cause radially expansion of a portion of the cup 34, thereby engaging the rifling of barrel 22.

As depicted in FIGS. 21-24, a bullet 130, according to an embodiment of the present invention, comprises a bullet body 132 and a radially deforming polymer component comprising a cup with an axial post 148. The cup is configured as an obturation skirt 134. The bullet body 132 further comprises a generally tapered head portion 136 and a boat tail 138. The boat tail 138 defines an angled camming surface 140. The obturation skirt 134 further comprises at least one wall 142 defining a cup for receiving the boat tail 138 of the bullet body 132. The wall 142 is angled to follow the angle of the camming surface 140. In an embodiment, the obturation skirt 34 can comprise a single circumferential wall 142 encircling the cup as depicted in FIGS. 25-28. In another aspect, the obturation skirt 134 can further comprise a plurality of petals 140 positioned to define the cup.

During loading, seating the bullet 130 against the propellant charge 28 pushes the walls 142 of the obturation skirt 134 against the camming surface 140, which is angled to deform the walls 142 radially outward to engage the barrel 22 and the rifling. Alternatively, during firing, the expanding propellant gases push against the obturation skirt 134 against the caroming surface 140 of the bullet body 132 to radially expand the obturation skirt 134. In an embodiment, the obturation skirt 134 can comprise a second cup portion 144 is positioned at the rear of the bullet 130 opposite the cup defined by the wall 142. The second cup portion 144 is shaped to capture the propellant gases and facilitate efficient launch of the bullet 130.

As depicted in FIGS. 25-28, in an embodiment, the bullet body 132 can define an axial well cavity 146 aligned with the central longitudinal axis a-a of the bullet body 132. The obturation skirt 134 further comprises an axial post 148 insertable into the well cavity 146. The axial post 148 maintains the correct alignment of the obturation skirt 134 to the bullet body 132 as the wall 142 is pressed against the camming surface 140 and deformed radially outward.

In an embodiment, the well cavity 146 defines an enlarged pressure chamber 150 at one end of the well cavity 146. In this configuration, the axial post 148 defines a lumen 152 for conveying propellant gases into the pressure chamber 150. During firing, the pressure chamber 150 is pressurized by the propellant gases. The main body of propellant gases behind the obturation skirt 134 maintains the obturation skirt 134 against the camming surface 140 as the bullet 130 travels down the barrel 22. Upon leaving the barrel 22, the main body of propellant gases dissipates allowing the pressurized pressure chamber 150 to push against the axial post 148 and separate the obturation skirt 134 from the bullet body 132.

Figure 29:
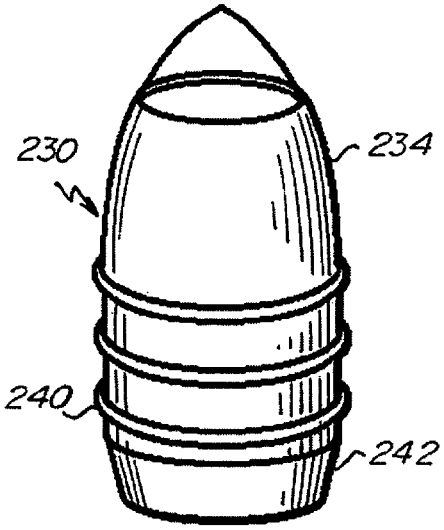
FIG. 29 is a perspective view of a jacketed bullet according to an embodiment of the present invention.
Figure 31:
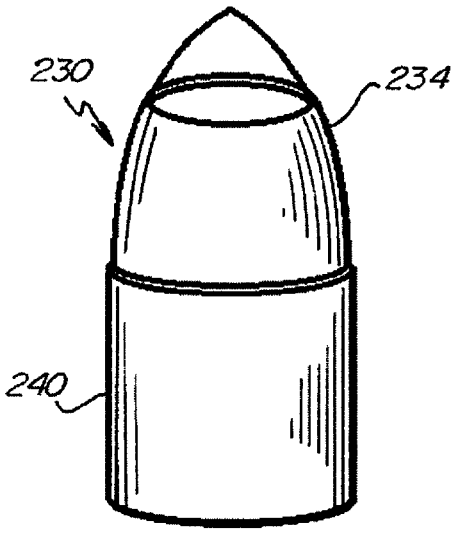
FIG. 31 is a perspective view of a jacketed bullet according to an embodiment of the present invention.
Figure 30:
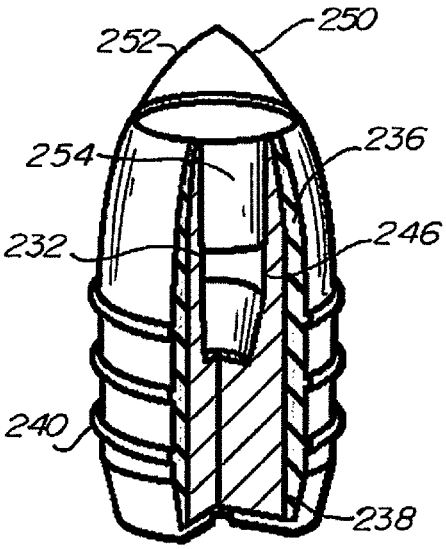
FIG. 30 is a partial cross-sectional perspective view of the jacketed bullet depicted in FIG. 29.
Figure 32:
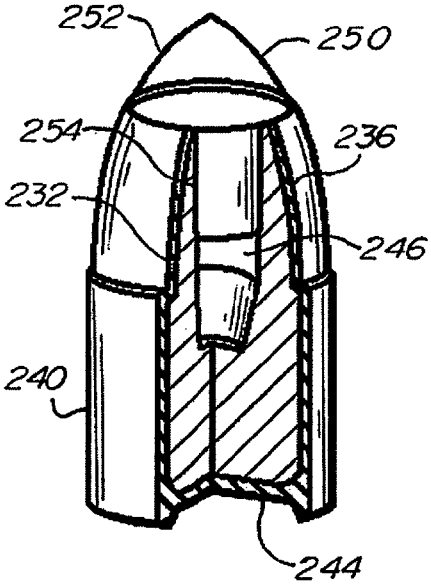
FIG. 32 is a partial cross-sectional perspective view of the jacketed bullet depicted in FIG. 31.

As depicted in FIGS. 29-32, a cupped bullet 230, according to an embodiment of the present invention, comprises a bullet body 232 and a polymer jacket 234. The bullet body 232 further comprises a tapered head portion 236 and a cylindrical tail portion 238. In an embodiment, the bullet body 232 can comprise a metal or metal composite including, but not limited to lead, steel, tungsten or other conventional bullet materials. The polymer jacket 234 further comprises at least one molded driving band 240 extending circumferentially around the cylindrical tail portion 38. In an embodiment, the polymer jacket 234 can comprise a plurality of driving bands 240 spaced along the cylindrical tail portion 238 as depicted in FIGS. 29-30. The driving bands 240 are spaced along the cylindrical tail portion 38 to maintain sufficient contact with the barrel 22 to maintain the alignment of the bullet body 232 within the barrel 22 and seal the bullet 230 to the barrel 22. In another aspect, the polymer jacket 234 can comprise a single driving band 240 extending axially to encompass a substantial portion of the tail portion 238 as depicted in FIGS. 31-32.

As depicted in FIGS. 29-32, in an embodiment, the polymer jacket 234 further comprises at least one molded ballistic element. As depicted in FIG. 30, the molded element can comprise a molded boat tail 242 at the rear of the bullet 230. The molded boat tail 242 reduces the drag caused by the cylindrical tail portion 238 of the bullet 230. As depicted in FIG. 326, the molded element can comprise an obturation skirt portion 244 at the rear of the bullet 230. The obturation skirt 244 further comprises a cup portion 246 oriented rearward from the cylindrical tail portion 238 of the bullet body 232 to capture propellant gases from the propellant charge 28. The cup portion 246 expands radially during firing to seal the bullet 230 against the barrel 22.

As depicted in FIG. 29-32, in an embodiment, the bullet body 232 can further comprise an axial well cavity 46. In this configuration, the bullet body 232 defines a frustotapered head portion 248. The well cavity 246 facilitates the mushrooming of the head portion 248 upon impact with the target. In an embodiment, the bullet 230 can further comprise a tip insert 50 having a tapered head portion 252 and a tail portion 254 insertable into the well cavity 246. The tapered head portion 252 is shaped to align with the frustotapered head portion 248 when the tail portion 254 is inserted into the well cavity 246.

A method of manufacturing a jacketed bullet 230 comprises providing a bullet body 232 having a frustotapered head portion 248 and a cylindrical tail portion 238, wherein the bullet body 232 defines an axial well cavity 254. The method also comprises inserting a tail portion 254 of a tip insert 50 into the well cavity 246, wherein the tip insert 250 comprises a tapered head portion 252 that aligns with frustotapered head portion 248 to provide an aerodynamic body. The method further comprises over-molding a polymer jacket 234 onto the bullet body 232, wherein the tip insert 250 and the polymer jacket 234 cooperate to cover the exterior of the bullet body 32. The method can also comprise molding at least one driving band 240 on the portion of the polymer jacket 234 encompassing the cylindrical tail portion 238 of the bullet body 232. In an embodiment, the method can further comprise molding at least one molded element onto the polymer body 234 selected from the group of an obturation skirt 244, a boat tail 242, or combinations thereof.

As depicted in FIGS. 33-36, a tipped bullet 330, according to an embodiment of the present invention, comprises a bullet body 332 defining an axial bullet well cavity 334. The axial bullet well cavity 334 further comprises a mouth 336 defining an opening into the axial bullet well cavity 334. The tipped bullet 330 also comprises a tip insert 338 having a tapered head portion 340 and a generally cylindrical tip tail portion 342 insertable into the mouth 336 of the bullet well cavity 334. The tip tail portion 342 is moveable between an extended position, depicted in FIGS. 31 and 33, in which a portion of the tip tail portion 342 protrudes from the mouth 336 of the bullet well cavity 334 and a retracted position, depicted in FIGS. 32 and 34, in which the tip tail portion 342 is fully seated within the bullet well cavity 334.

Figure 33:
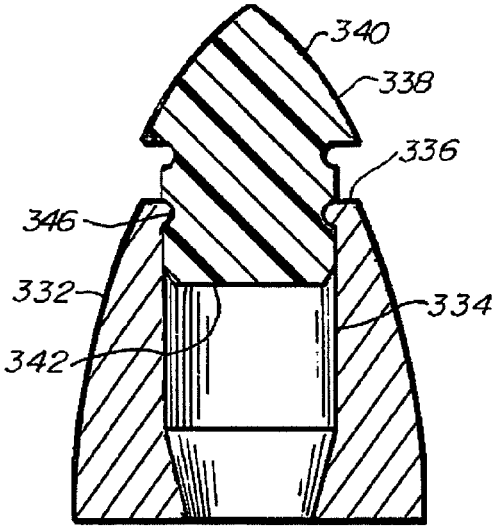
FIG. 33 is a cross-sectional side view of a bullet with a seat force indicator tip insert positioned in the extended position.
Figure 34:
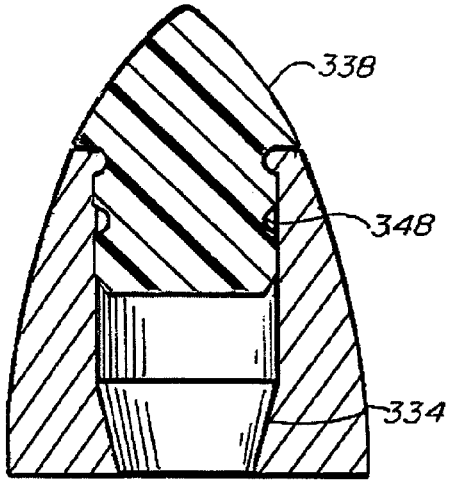
FIG. 34 is a cross-sectional side view of the bullet depicted in FIG. 33 with the seat force indicator tip insert positioned in the retracted position.

As depicted in FIGS. 33 and 34, in an embodiment, the bullet 330 can define a collar portion 344 at the mouth 336 of the bullet well cavity 334. The collar portion 344 further comprises at least one collar protrusion 346 extending radially inward to engage the tip tail portion 342. In an embodiment, the collar protrusion 346 comprises a reduced diameter portion extending around the entire circumference of the mouth 36 of the bullet well cavity 334. The tip tail portion 342 further comprises a first groove 348 positioned to engage the collar protrusion 346 when the tail portion 42 is positioned in the extended position as depicted in FIG. 33. The engagement of the collar protrusion 346 to the first groove 348 maintains the tip tail portion 342 in the extended position until an axial force exceeding a predetermined threshold is applied to the tip insert 338, which disengages the collar protrusion 346 from the first groove 348. In an embodiment, the tip tail portion 342 further comprises a second groove 348 positioned to engage the collar protrusion 346 when the tip tail portion 342 is positioned in the retracted position as depicted in FIG. 34.

Figure 35:
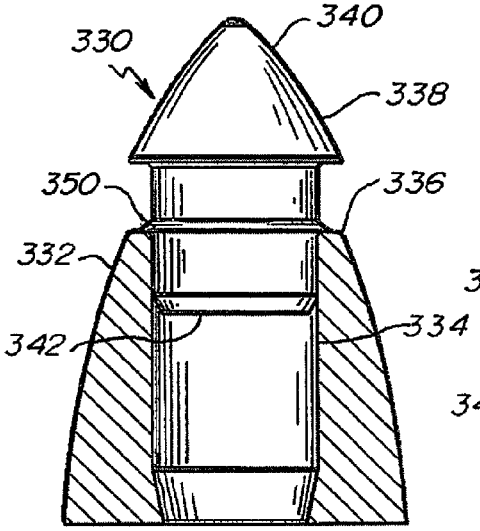
FIG. 35 is a cross-sectional side view of a bullet with a seat force indicator tip insert positioned in the extended position.
Figure 36:
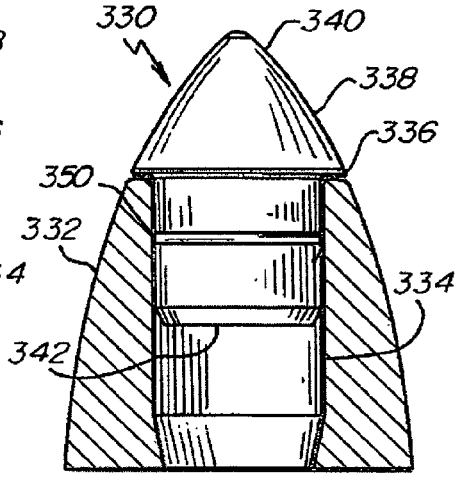
FIG. 36 is a cross-sectional side view of the bullet depicted in FIG. 35 with the seat force indicator tip insert positioned in the retracted position
Figure 37:
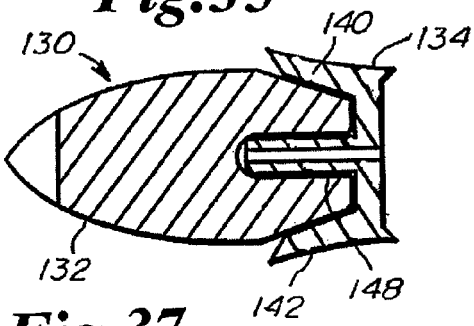
FIG. 37 is a cross-sectional of bullet according to an embodiment of the invention where the skirt is formed of a malleable metal.
Figure 38:
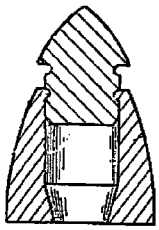
FIG. 38 is a cross-sectional side view of a bullet with a seat force indicator tip insert positioned in the extended position with the tip formed of a non-polymer such as a metal.

As depicted in FIGS. 35-36, in an embodiment, the tip tail portion 342 can further comprise a tail protrusion 350 that extends radially outward. The tail protrusion 350 is positioned to engage the mouth 336 of the bullet well cavity 334 when the tip tail portion 342 is positioned in the extended position, as depicted in FIG. 33, to maintain the tip tail portion 342 in the extended position until an axial force exceeding a predetermined threshold is applied to the tip insert 338. If an axial force exceeding the predetermined threshold is applied to the tip insert 338 the tail protrusion 350 deforms allowing the tip tail portion 342 to move into the retracted position.

As depicted in FIGS. 29-34, in operation, the tipped bullet 330 is loaded into the muzzle 24 of the barrel 22 with the tip insert 338 positioned in the extended position. An axial force is applied to the tipped bullet 330 with the ramrod to overcome the friction between the bullet 330 and the barrel 22 to allow the bullet 330 to slide down the barrel 22. The predetermined axial. force threshold is greater than the axial force necessary to overcome the friction between the bullet 330 and the barrel 22. As the bullet 330 is being pushed down the barrel 22, the axial force applied to the bullet 330 cannot exceed the force necessary to overcome the friction between the bullet 330 and the barrel 22. Upon seating of the bullet 330 against the propellant charge 28 at the breech end of the 26 of the barrel 22, sufficient axial force can be applied to the tip insert 338 to exceed the axial force threshold and move the tip insert 338 into the retracted position. The movement of the tip insert 338 into the retracted position provides a tactile sensation through the ramrod to the user that seating force has exceeded the necessary threshold to properly seat the bullet 330 against the propellant charge 28.

A method of loading a tipped bullet 330, according to an embodiment of the present invention, comprises providing a bullet 330 and a tip insert 338 having a tip tail portion 342 movable within a bullet well cavity 334 defined by the bullet 330 between an extended position and a retracted position. The method further comprises loading the bullet 330 into the barrel 22 of the muzzleloader 20 in the extended position and applying an axial force to bullet 330 with a ramrod to move the bullet 330 to the breech end 26 of the barrel 22, wherein the bullet 330 defines a reduced diameter portion engageable to the tip tail portion 342 to maintain the tip tail portion 342 in the extended position as the bullet is pushed down the barrel. The method also comprises seating the bullet 330 against a propellant charge 28 in the breech end 26 and applying an additional axial force with the ramrod to the tip insert 338 to move the tip tail portion 342 into the retracted position.

Figure 39:
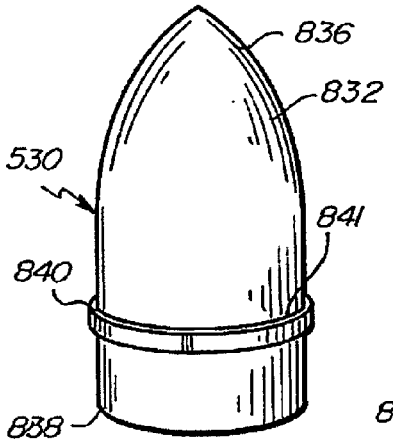
FIG. 39 is a side perspective view of a bullet according to an embodiment of the present invention, wherein an obturation band of the bullet is positioned in the pre-fired position.
Figure 40:
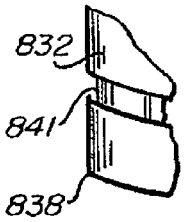
FIG. 40 is a side sectional view of a portion of the bullet according to an embodiment of the present invention shown in FIG. 39, wherein the obturation band of the bullet is removed.
Figure 41:
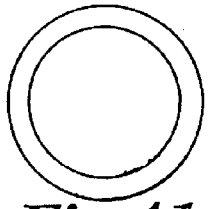
FIG. 41 is top plan view of a bullet according to an embodiment of the present invention with an obturation skirt.

As depicted in FIGS. 39-41, a bullet 830, according to an embodiment of the present invention, comprises a bullet body 832 and a deforming polymer component comprising one or more obturation polymer bands 840 extending circumferentially around the bullet body 832. The bullet body 132 further comprises a generally tapered head portion 836 and a cylindrical tail 838.

Figure 44:
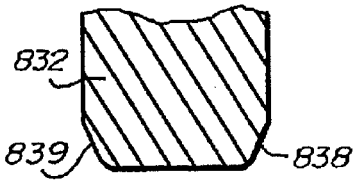
FIG. 44 is a sectional view of a portion of the bullet according to a further embodiment of the present invention shown in FIG. 39, wherein the tail end of the bullet is a boat tail.

In another aspect of the invention, the cylindrical tail 838 is a boat tail 839 shaped, as shown in FIG. 44.

The obturation bands 840 comprise an elastomeric material which form fits within a circumferential groove 841 in the bullet body 832. The groove is best seen in FIG. 40, which is a side sectional view of a portion of the bullet 830 according to an embodiment of the present invention shown in FIG. 39, wherein the obturation band 840 of the bullet is removed. An obturation band 840 of the invention may be elastomeric such that it conforms to and constricts the groove 841 of the bullet body 832.

In an embodiment, as seen in FIG. 41, the bullet body 832 comprises more than one groove 841 with more than one obturation band 840. The band(s) 840 are positioned along the bullet body 832 to optimize obturation. As such, in some aspects of the invention, the bands 840 and grooves 841 are position at the widest portions or bourrelet of the bullet body 832. In other aspects, the bands 840 and accompanying grooves 841 are positioned at narrower portions of the bullet body 832. In this case, the bands' radial thickness is greater to accommodate the greater distance to the inside surface of the barrel 22.

The driving bands 840 are spaced along the cylindrical tail portion 838 to maintain sufficient contact with the barrel 22 to maintain the alignment of the bullet body 832 within the barrel 22 and seal the bullet 830 to the barrel 22.

Figure 42:
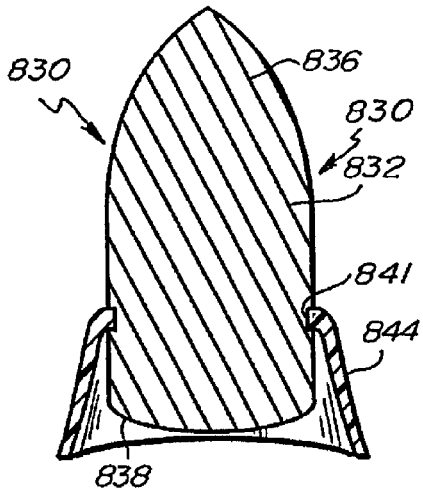
FIG. 42 is a cross-sectional side view along the longitudinal axis of a bullet according to an embodiment of the present invention, wherein an obturation skirt of the bullet is positioned in the pre-fired position.
Figure 43:
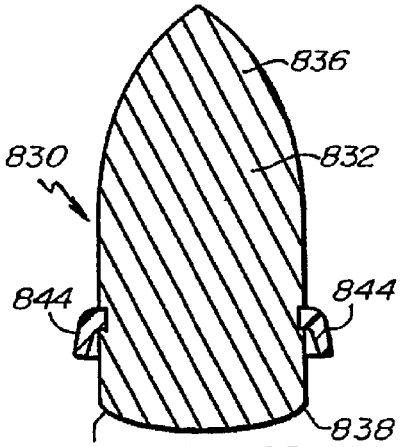
FIG. 43 is a cross-sectional side view along the longitudinal axis of a bullet according to an embodiment of the present invention, wherein an obturation skirt of the bullet is positioned in the pre-fired position.

In another aspect, as shown in FIGS. 42 and 43, the radial thickness of the obturation band is increased to form an obturation skirt 844. As seen in FIG. 42, the obturation skirt may extend downward along the bullet body 832 and past the bullet tail end 838. In some aspects of the invention, the obturation skirt 844 is not form fitting along its length to the bullet body 832. The skirt 844 includes portions radially beyond the point of engagement between the skirt 844 and the bullet body 832 that have greater resting inner diameters than the outer diameter of the bullet body 832 when the skirt 844 is wrapped around the tail end 838 of the bullet body 832. In a further aspect of the invention, the skirt 844 extends down around the bullet body 832 and terminates short of the terminating end 839 of the bullet tail end 838.

During firing, the expanding propellant gases push against the underside of the obturation skirt 844, expanding the skirt 844 radially against the inner surface of the barrel 22 to seal the bullet 830 against the barrel 22.

A method of manufacturing a bullet 830 comprises providing a bullet body 832 having a frustotapered head portion 836, a cylindrical tail portion 838 and a circumferential groove 841 radially around the bulled body 832. The method also comprises inserting a polymer band 840 into the groove 841. The method further comprises providing the bullet body 832 with a plurality of grooves 841 and a plurality of corresponding polymer bands 841 and inserting one of the bands 841 into each groove 841.

A further method of manufacturing a bullet 830 comprises providing a bullet body 832 having a frustotapered head portion 836, a cylindrical tail portion 838 and a circumferential groove 841 radially around the bulled body 832. The method also comprises inserting a polymer skirt 844 into the groove 841. In an aspect of the method, the skirt 844 extends down the bullet body 832 and past the tail portion 838. In another aspect, the skirt extends down the bullet body short of the terminating end of the tail portion 838.

Figure 45A:
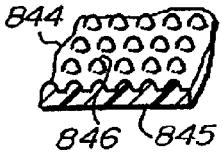
FIG. 45A is a sectional view of a portion the skirt of the bullet according to a further embodiment of the present invention shown in FIG. 42, wherein an outer surface of the skirt of the bullet is knurled.
Figure 45B:
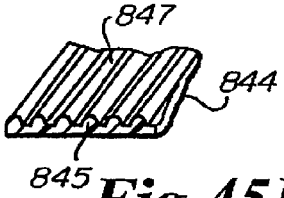
FIG. 45B is a sectional view of a portion the skirt of the bullet according to a further embodiment of the present invention shown in FIG. 42, wherein an outer surface of the skirt of the bullet is splined.

According to further aspects of the invention, the skirt 844 is knurled 846 as shown in FIG. 45A (showing a sectional portion of a skirt at the skirt's terminating end 845) or splined as shown in FIG. 45B (showing a sectional portion of a skirt at the skirt's terminating end 845) to create an interface with the barrel 22 to encourage rotational lock-up.

The projectile, in use, rides on the lands of the rifled barrel 22 and the polymer band(s)/skirt 840/844, which extend from the groove(s) 841 of the bullet body 832, fill and seal the grooves of the rifled barrel preventing propellant gas leakage. The grooves 841 and band(s)/skirt 840/844 are physically dimensioned and formed to ensure mechanical integrity is maintained. Better transmission of spin to the projectile provides better dynamic stability and results in better accuracy. Locating the polymer on the bourrelet of the projectile with a reduced length allows for lower insertion force (ease of loading) as well as improved filling of the rifling grooves (obturation). Energy generated by the propellant is better transmitted to the projectile and not allowed to bleed past the bullet.

According to further aspects of the invention, the bands/skirts 840/844 are elastomeric and removable allowing for installation of specific diameter bands by the end user. This user modification allows for projectile customization/optimization to a specific rifle thereby accommodating any of the bore diameter variations which are common to the industry. In further aspects of the invention, there is provided consumer kits with bands/skirts 840/844 of several different diameters for end user customization of the projectile configuration.

Suitable materials for the bands 840 and skirt 844, include, but are not limited to, polymer material comprising nylon, polyethylene, polypropylene and suitable elastomeric materials. In certain aspects, the polymer material can be opaque or translucent. In another aspect, the polymer material can include a friction reducing additive or be formed of fluoropolymers.

According to aspects of the invention, the bullet body 832 may comprises lead, aluminum, any suitable metallic and lead-free material, a metallic/polymer composition or a polymer based material. In some aspects, the bullet body may be jacketed with suitable materials, including copper and any other suitable jacket material. If the bullet body comprises a polymer material, the bands/skirt 840/844 may form a materially integrated part of the bullet body 832.

While the invention is amenable to various modifications and alternative forms, specifics thereof have been depicted by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims. The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A bullet system for a muzzleloader, the bullet system comprising a bullet body and a polymer cup, the bullet body having a forward tapered end and a rearward tail portion, the tail portion having a tapered region with a radius of the tail portion increasing in the forward direction;

the polymer cup having an open end and a closed end and being slidingly engaged on the tail portion of the bullet body, the cup having a radially deformable side wall portion positioned at the tapered region such that when the cup is slid axially forward on the tail portion, the radially deformable side wall portion engages the tapered region and is deformed radially outward at said deformable side wall portion.

2. The bullet system of claim 1 wherein the tail portion of the bullet body has a cylindrical portion, and a second tapered portion, the radially deformable side wall portion positioned at the second tapered portion whereby when the cup is slid axially forward on the tail portion, the deformable side wall portion is also deformed radially outward at the second tapered portion.

3. The bullet system of claim 1 wherein the cup is slidably secured to the bullet body such that when the bullet body and cup are fired from the muzzleloader, the cup remains secured to the bullet body.

4. The bullet system of claim 1 wherein the cup has a rigid ring portion with a circular cutting edge positioned at the closed end of the cup for scraping a barrel of a firearm upon insertion of the bullet system into the barrel.

5. The bullet system of claim 1 wherein the bullet body has an outwardly facing conical surface and the cup has an inwardly facing conical surface and wherein upon moving the cup forwardly on the rearward tail portion, the respective conical surfaces cooperate to radially expand the cup.

6. The bullet system of claim 5 wherein the cup comprises a rearward end portion and a skirt portion that extends forwardly, the skirt portion having an outer lip that defines a maximum radius of the bullet system when in the axial shortened state.

7. The bullet system of claim 5 wherein the cup has an axial post that cooperates and moves axially within an axial opening extending into the rear tail portion of the bullet body.

8. The bullet system of claim 7 wherein the post has a securement position corresponding to the axial shortened state of the bullet system whereby the bullet system is locked into the axial shortened state.

9. The bullet system of claim 7 wherein the tail and axial opening provides a bias against insertion of the post facilitating axial expansion of the bullet system after the bullet exits the firearm and thereby separation of the cup from the bullet body.

10. A bullet system for muzzleloading comprising a bullet body and a cup with a closed rearward end, the cup axially movable on the exterior of the bullet body, the bullet system having a first axial elongated state wherein the cup is positioned rearwardly on the bullet body with a corresponding initial radius that facilitates the loading of the bullet down the barrel of a muzzleloader, and a second axial shortened state wherein the cup is positioned forwardly compared to the first axially elongated state, the second axial shortened state with a corresponding radially expanded portion of the cup that is greater than the initial radius and provides a sealing of the bullet system with a barrel during firing, the corresponding radially expanded portion of the cup effected by way of the cup engaging a camming surface on the bullet body when the bullet transitions from the first axially elongated state to the second axially shortened state.

11. The bullet system of claim 10 wherein the cup and bullet body are separable from one another after the bullet system leaves the barrel.

12. The bullet system of claim 10 wherein the camming surface is on a tail portion of the bullet body and comprises a tapered surface.

13. The bullet system of claim 10 wherein the cup has a rearwardly facing cutting surface extending around the cup at a rearward end of the cup sized to scrape the barrel when loaded into the muzzle loader.

14. The bullet system of claim 10 wherein the cup portion has a second radially expanded portion in the second axial shortened state.

15. The bullet system of claim 10 wherein the cup is slidably secured to the bullet body such that when the bullet body and cup are fired from the muzz1eloader, the cup remains secured to the bullet body.

16. The bullet system of claim 1 wherein the bullet body comprises a metal and the cup comprises a polymer, and wherein when the cup is slid axially forward on the tail portion, the cup portion is frictionally retained on the bullet body whereby the cup does not separate from the bullet body after firing from the muzzleloader.

17. A bullet system for muzzleloading, the bullet system comprising a bullet body and a cup with a closed rearward end, the bullet body having at least one increased radius portion thereon, the cup axially movable on the bullet body, the bullet system having a first axial length wherein the cup is positioned rearwardly on the bullet body with a corresponding first maximum radius of the cup that facilitates the loading of the bullet system down a barrel of a muzzleloader, and a shorter second axial length wherein the cup is positioned forwardly on the bullet body compared to the first axial length, the bullet having a second maximum radius of the cup at the second axial length, said second maximum radius is greater than the first maximum radius of the cup, the second maximum radius effected when the cup slides over the increased radius portion.

* * * * *